US005098818A

United States Patent [19]

Ito et al.

[11] Patent Number: 5,098,818

[45] Date of Patent: Mar. 24, 1992

[54] SILVER HALIDE PHOTOGRAPHIC MATERIAL AND METHOD FOR PROCESSING THEREOF

[75] Inventors: Tadashi Ito; Yasushi Hattori; Yukio Karino, all of Kanagawa, Japan

[73] Assignee: Fuji Photo Film Co., Ltd., Kanagawa, Japan

[21] Appl. No.: 505,752

[22] Filed: Apr. 6, 1990

[30] Foreign Application Priority Data

Apr. 6, 1989 [JP] Japan ..... 1-87367
Feb. 15, 1990 [JP] Japan ..... 2-34738

[51] Int. Cl.[5] ..... G03C 5/18

[52] U.S. Cl. ..... 430/434; 430/517; 430/522; 430/536; 430/963; 430/966

[58] Field of Search ..... 430/510, 522, 517, 434, 430/963, 966

[56] References Cited

U.S. PATENT DOCUMENTS 3,647,460 3/1972 Hofman et al. ..... 430/963
4,288,534 9/1981 Lemahieu et al. ..... 430/510
4,294,917 10/1981 Postle et al. ..... 430/522
4,803,150 2/1989 Dickerson et al. ..... 430/966
4,855,221 8/1989 Factor et al. ..... 430/510
4,897,340 1/1990 Ohtani et al. ..... 430/963
4,900,652 2/1990 Dickerson et al. ..... 430/517
4,900,653 2/1990 Factor et al. ..... 430/522
4,940,654 7/1990 Diehl et al. ..... 430/510
4,948,718 8/1990 Factor et al. ..... 430/510
4,994,355 2/1991 Dickerson et al. ..... 430/966
4,994,356 2/1991 Diehl et al. ..... 430/522
4,997,750 3/1991 Dickerson et al. ..... 430/963

FOREIGN PATENT DOCUMENTS 0274723 7/1988 European Pat. Off. .
0276566 8/1988 European Pat. Off. .
0307867 3/1989 European Pat. Off. .

*Primary Examiner*—Charles L. Bowers, Jr.
*Assistant Examiner*—Thomas R. Neville
*Attorney, Agent, or Firm*—Sughrue, Mion, Zinn, Macpeak & Seas

[57] ABSTRACT

A silver halide photographic material is disclosed, comprising a hydrophilic layer containing a dye dispersed in a solid particle form therein on at least one side of a support and at least one silver halide emulsion layer, wherein the coating weight of hydrophilic colloid in said layer containing a dye dispersed in a solid particle form therein is from 0.05 to 0.5 g/m$^2$ and the total coating weight of hydrophilic colloid on each side of said support is from 0.5 to 3 g/m$^2$.

5 Claims, No Drawings

SILVER HALIDE PHOTOGRAPHIC MATERIAL AND METHOD FOR PROCESSING THEREOF

FIELD OF THE INVENTION

This invention relates to a silver halide photographic material. More particularly, this invention relates to a silver halide photographic material having a hydrophilic colloid layer containing a dye (a colored layer) which can be rapidly processed and to a method for processing the photographic material.

BACKGROUND OF THE INVENTION

Conventionally-used black-and-white photographic materials (for X-rays, plate making and microcopies) are developed in a short period of time of from one to five minutes by using automatic processors. However, photographic processors wish to complete processing even faster to accommodate the increase in photographs being taken. Also, photographic materials like those used for X-rays must be processed as soon as possible to provide important information in a timely manner. Under these circumstances, the time taken for the development of photographic materials is being decreased from a period of more than one minute to a period of one minute or less.

In addition, medical photographic materials giving X-ray photographic images of high quality are required for improving diagnostic accuracy. Also, photographic materials for plate making are repeatedly subjected to processing stages. However, when the photographic materials do not have sufficient resolving power, the image fades every time the materials are processed. For this reason, photographic materials giving images of high quality are being demanded.

Further, photographic materials for plate making are often being exposed to laser beams. They must provide images of high quality even under high illumination. In microcopies, photographed images are not directly observed; instead, enlarged photographs are observed, and images of high quality are demanded.

Thus, it should be understood that rapid processing in a period of time of not longer than 60 seconds and images of high quality being required.

Attempts have been made to provide photographic materials giving images of good quality. For example, photographic emulsion layers or other layers have been colored to absorb light having a specific wavelength. A colored layer has been provided between a photographic emulsion layer and a support or on the side opposed to the emulsion layer-side of the support for the purpose of preventing image from being faded by the fact that incident light is reflected during the passage thereof through the photographic emulsion layers, or transmitted light is scattered and reflected at the interface between the emulsion layer and the support or on the surface of the side opposed to the emulsion layer-side of the support, and reflected light enters again the photographic emulsions, that is, for the purpose of antihalation. The colored layer is called antihalation layer (AH layer). In the photographic materials for X-ray photographs, a colored layer is sometimes provided as a crossover cut layer for reducing crossover light to improve sharpness.

These colored layers often comprise hydrophilic colloid. Hence, dyes are generally incorporated in these layers to color them. The dyes must meet the following requirements.

(1) The dyes must have proper spectral absorption according to the purposes of their use.

(2) The dyes must be chemically inactive in regard to the photographic material. Namely, they can not chemically have an adverse effects on the performance of photographic silver halide emulsion layers. For example, they cannot cause a lowering of sensitivity, latent image fading or fogging.

(3) The dyes must be either decolorized, or dissolved and removed during the course of development to prevent harmful after-color from being left on the photographic materials after processing.

Methods for providing dye-containing layers include a method wherein soluble dyes are dissolved in hydrophilic colloid layers as disclosed in U.K. Patents 1,414,456, 1,477,638 and 1,477,639. This method has the disadvantage in that when the solubility of the dyes in water is increased to solve the problem of after-color, the fixing degree of the dyes are reduced, the dyes are diffused in layers adjacent to the dye-containing layer and desensitization or the re-transfer of the dyes to other photographic materials result. Methods wherein hydrophilic polymers having an electric charge opposite to dissociated anionic dyes are allowed to coexist as mordants in a layer to thereby localize the dyes in a specific layer by the interaction between dye molecules and polymers, are described in U.S. Pat. Nos. 2,548,564, 4,124,386 and 3,625,694. However, these methods have the disadvantages in that when anionic substances and dyes exist in the same layer, an undesirable effect on the manufacturing process results so that the dyes are not satisfactorily localized and the coating solutions cause agglomeration.

To solve these problems, a method has been proposed wherein dyes dispersed in the form of solid particle are allowed to exist between the support and the emulsion layer as disclosed in U.S. Pat. No. 4,803,150 and WO 88/04794. This method is an excellent technique for providing an image of high quality without causing desensitization.

However, this method has problems in the production of the photographic materials and the rapid processing in a period of time of not longer than 60 seconds. First, the problem of rapid processing will be discussed. When an additional layer is provided as an AH layer, the total amount of hydrophilic colloid is increased, because the AH layer generally comprises hydrophilic colloid. When the amount of hydrophilic colloid increases, the amount of water absorbed by the photographic material in the processing stage increases and drying is adversely affected. This is a serious problem for rapid processing in a period of time of not longer than 60 seconds. Also, the amount of hypo (sodium thiosulfate) left in the photographic materials for X-ray photographs and microcopies after development must be small, because the photographic materials are stored over a long period of time. When the amount of hydrophilic colloid is large, the amount of hypo absorbed in fixing solutions increases, and the rinsing time must be prolonged to wash the hypo off. This is a serious problem for rapid processing. In regard to the problem in the production of the photographic materials, the extra layer complicates the production process and tends to cause surface troubles.

SUMMARY OF THE INVENTION

An object of the present invention is to provide a silver halide photographic material which experiences less after-color, gives an image of high quality (particularly sharpness) and has improved rapid-processability (e.g., dryness, pressure resistance).

Another object of the present invention is to provide a method for processing the photographic material.

The above objects of the present invention have been achieved by providing:

a silver halide photographic material comprising a hydrophilic colloid layer containing a dye dispersed in a solid particle form (which may include microcrystalline) therein on at least one side of a support and at least one silver halide emulsion layer, wherein the coating weight of the hydrophilic colloid in the hydrophilic colloid layer containing a dye dispersed in a solid particle form is from 0.05 to 0.5 $g/m^2$ and the total coating weight of hydrophilic colloid on each side of the support is from 0.5 to 3 $g/m^2$; and a method for rapidly processing the photographic material in a time period of at most 60 seconds.

DETAILED DESCRIPTION OF THE INVENTION

In the present invention, it is particularly preferred to incorporate a dye in the hydrophilic colloid of an undercoat layer (a subbing layer) so that an extra hydrophilic colloid layer is not needed to contain the dye, that is, the hydrophilic colloid layer containing a dye (which is referred as "colored layer" sometimes) is preferably an undercoat layer.

The term "undercoat layer" or "subbing layer" as used herein refers to a layer which plays a role in imparting adhesion between the support and a hydrophilic layer such as an emulsion layer. Undercoat layer may comprise a first undercoat layer which contains polymers on a surface of a support and a second undercoat layer which contains hydrophilic colloid on the first undercoat layer, or comprise a hydrophilic colloid layer on a surface of a support.

First, the method providing undercoat layer which comprises the first undercoat layer and the second undercoat layer will be discussed below.

When a base coated with only a polymer is coated with hydrophilic colloid such as an emulsion at a temperature not higher than 80° C., adhesion between the polymer and the emulsion is poor and hence there is the problem that the layer peels off. To solve this problem, hydrophilic colloid for the second undercoat layer is generally coated on the of the polymer coat (first undercoat layer) at a temperature not lower than 80° C. Accordingly, the hydrophilic layer (second undercoat layer) is considered to be an undercoat layer according to the definition of the present invention. In a preferred embodiment of the present invention, the dye is incorporated in this hydrophilic layer (second undercoat layer).

The thickness of the first undercoat layer is preferably not more than 0.5 μm, more preferably from 0.05 to 0.4 μm and the thickness of the second undercoat layer is preferably not more than 0.5 μm, more preferably from 0.05 to 0.4 μm.

Generally, the undercoat polymer layer (first undercoat layer) is hydrophobic and does not allow water to permeate easily therethrough. Accordingly, when the dye is incorporated in the undercoat polymer layer, after-color is formed which cannot be discharged. Hence, it is desirable that the dye is substantially not incorporated in the undercoat polymer layer in the present invention.

Second, the method providing a undercoat layer which comprises a hydrophilic colloid layer will be discussed below.

In an embodiment of the present invention, the dye is incorporated in the hydrophilic colloid for the undercoat layer. The thickness of the undercoat layer is preferably not more than 1.0 μm, more preferably from 0.1 to 0.8 μm. Hydrophilic colloid, a polyethylene swelling agent and organic solvents are used during coating for the undercoat layer. Therefore, dyes which are deteriorated by the organic solvents cannot be used, thus limiting the dyes which can be used to certain compounds.

Accordingly, undercoat layer which comprises a first undercoat layer which contains polymers on a surface of a support and a second undercoat layer which contains hydrophilic colloid on the first undercoat layer are preferable in the present invention. The dye is preferably incorporated in the second undercoat layer in the present invention.

Methods for coating the undercoat layer include a multi-layer coating method wherein a layer having good adhesion to a support is provided as a first layer and a hydrophilic layer provided as a second layer is coated thereon as described in JP-A-52-49019 (the term "JP-A" as used herein means an "unexamined published Japanese patent application"), JP-A-52-42114 and JP-A-52-104913 and a method wherein only one layer of a polymer layer having both a hydrophobic group and a hydrophilic group is coated as described in JP-B-47-24270 (the term "JP-B" as used herein means an "examined Japanese patent application") and JP-A-51-30274. The effect of the present invention can be obtained by any of the above methods, but the multi layer coating method is preferable.

A conventionally-used support, such as a flexible support (e.g., plastic film, paper, cloth) or a rigid support (e.g., glass, ceramic, metal) may be used in the present invention. Examples of useful flexible supports include films of semisynthetic or synthetic high-molecular weight materials such as cellulose nitrate, cellulose acetate, cellulose acetate butyrate, polystyrene, polyvinyl chloride, polyethylene terephthalate and polycarbonate; and paper such as baryta paper and paper coated or laminated with an α-olefin polymer (e.g., paper coated or laminated with polyethylene, polypropylene or an ethylene/butene copolymer). These supports may be colored by using dyes or pigments, or they may be colored black to shield light. In any of the above-described methods, in regard to the resulting effect, it is preferred that the surfaces of supports are treated before the undercoat layer is coated. Examples of surface treatments include chemical treatment, mechanical treatment, corona discharge treatment, flame treatment, ultraviolet light treatment, high-frequency treatment, glow discharge treatment, active plasma treatment, laser treatment, mixed acid treatment and ozone oxidizing treatment.

A hydrophilic layer may be provided between the polymer layer and the colored layer. Alternatively, a hydrophilic layer may be provided between the colored layer and the emulsion layer.

Preferably, the undercoat polymer layer (first undercoat layer) and the hydrophilic colloid layer (second undercoat layer) adjacent thereto are dried at a temperature of preferably from 80° to 200° C., more preferably from 80° to 155° C., for preferably 2 seconds to 5 minutes, more preferably 2 seconds to 60 seconds after coating. When both layers are dried at a temperature lower than 80° C., a serious problem results in which that photographic layers (e.g., silver halide emulsion layers) become detached from the support and peel off in automatic processors.

Examples of undercoat polymers which can be used for the first undercoat layer include halogenated synthetic resins such as polyvinyl chloride, polyvinyl bromide, polyvinyl fluoride, polyvinylidene chloride, polyvinyl acetate, chlorinated polyethylene, chlorinated polypropylene, brominated polyethylene, chlorinated rubber, vinyl chloride-ethylene copolymer, vinyl chloride-propylene copolymer, vinyl chloride-styrene copolymer, vinyl chloride-isobutylene copolymer, vinyl chloride-vinylidene chloride copolymer, vinyl chloride-styrene-maleic anhydride terpolymer, vinyl chloride-styrene-acrylonitrile copolymer, vinyl chloride-butadiene copolymer, vinyl chloride isoprene copolymer, vinyl chloride-chlorinated propylene copolymer, vinyl chloride-vinylidene chloride-vinyl acetate terpolymer, vinyl chloride-acrylic ester copolymer, vinyl chloride-maleic ester copolymer, vinyl chloride-methacrylic ester copolymer, vinyl chloride-acrylonitrile copolymer, internally plasticized polyvinyl chloride, vinyl chloride-vinyl acetate copolymer, polyvinylidene chloride, vinylidene chloride-methacrylic ester copolymer, vinylidene chloride-acrylonitrile copolymer, vinylidene chloride-acrylic ester copolymer, chloroethyl vinyl ether-acrylic ester copolymer and polyvinylidene fluoride; polyolefins such as polyethylene, polypropylene and poly-3-methylpentene; α-olefin copolymers such as ethylene-propylene copolymer, ethylene-propylene-1,4-hexadiene copolymer, ethylene-vinyl acetate copolymer, copolybutene-1-propylene and butadiene-acrylonitrile copolymer and blends of these copolymers with the halogenated resins; acrylic resins such as acrylic ester-acrylonitrile copolymer, acrylic ester-styrene copolymer, methacrylic ester-acrylonitrile copolymer, methacrylic ester-styrene copolymer, polyalkyl acrylate, acrylic acid-butyl acrylate copolymer, acrylic ester-butadiene-styrene copolymer, methacrylic ester-butadiene-styrene copolymer, methyl methacrylate/ethyl acrylate/2-hydroxyethyl acrylate/methacrylic acid (67/23/7/3 ratio by weight) copolymer, methyl methacrylate/ethyl acrylate/2-hydroxyethyl acrylate/methacrylic acid (72/17/7/3 ratio by weight) copolymer, methyl methacrylate/ethyl acrylate/2-hydroxyethyl acrylate/methacrylic acid (70/20/7/3 ratio by weight) copolymer and methyl methacrylate/-butyl acrylate/2-hydroxyethyl acrylate/methacrylic acid (70/20/7/3 ratio by weight) copolymer; polystyrene and copolymers of styrene with other monomers (e.g., maleic anhydride, butadiene and acrylonitrile) such as acrylonitrile-butadiene-styrene copolymer; polyacetal resin; polyvinyl alcohol; blends of these resins, block copolymers and graft copolymers of these resins; polyamide resin; polyvinyl butyral; cellulose derivatives; polyester resins; vinyl polymers such as polyvinyl alcohol; condensed high-molecular compounds such as polycarbonates and polyethers; rubber such as natural rubber, butyl rubber, neoprene rubber and styrene-butadiene copolymer rubber; natural or artificial rubber, silicone rubber, and polyurethane; polyamide, urethane elastomer, nylon-silicone resin, and nitrocellulose-polyamide resin; and blends of the above-listed acrylic, methacrylic, polyolefin, polyamide, polyester, polyurethane, polycarbonate, rubber, cellulose resin and aqueous polyester resins and their block copolymers and graft copolymers.

Among these polymers, styrene-butadiene copolymers and vinylidene chloride copolymers are particularly preferred.

In light-sensitive materials for printing, it is preferable to use hydrophobic polymers as an undercoat to prevent the dimensional stability of the support from being deteriorated by the water absorption of the support. Vinylidene chloride polymers are preferred.

In the present invention, it is most preferable to use these polymers in the form of latexes.

Preferably, dyes which absorb light in the sensitive region of the photographic material are used when the colored layer is introduced into the material to improve the quality of the image. The term "colored layer" as used herein means a hydrophilic colloid layer containing a dye.

In the present invention, the colored layer is preferably an undercoat layer.

The colored layer may be provided on one side or both sides of the support in the present invention.

Dyes which can be used in the present invention can be easily synthesized according to the methods described in WO 88/04794, European Patents EP027472-3Al, 276,566 and 299,435, JP-A-62-92716, JP-A-55-155350, JP-A-55-155351, JP-A-61-205934, JP-A-48-68623, and U.S. Pat. Nos. 2,527,583, 3,486,897, 3,746,539, 3,933,798, 4,130,429 and 4,040,841.

Dyes described in WO 88/04794 (Tables I to X), dyes represented by the following formulas (I) to (VI) and other dyes can be used in the present invention.

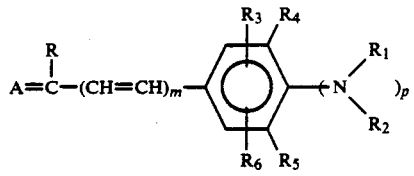
(I)

$$A{=}L_1{-}(L_2{=}L_3)_n{-}A' \quad \text{(III)}$$

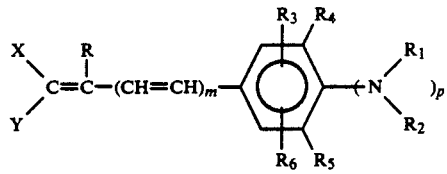
(II)

$$A{=}(L_1{-}L_2)_{2-q}{=}B \quad \text{(IV)}$$

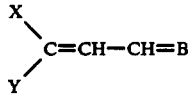
(V)

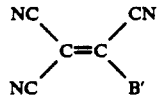
(VI)

In the above formulas, A and A' may be the same or different groups and each represents an acid nucleus; B represents a basic nucleus; X and Y may be the same or different groups and each represents an electron attractive group; R represents a hydrogen atom or an alkyl group; $R_1$ and $R_2$ each represent an alkyl group, an aryl group, an acyl group or a sulfonyl group, or $R_1$ and $R_2$ may be combined together to form a 5-membered or 6-membered ring; $R_3$ and $R_6$ each represent a hydrogen atom, hydroxyl group, carboxyl group, an alkyl group, an alkoxy group or a halogen atom; $R_4$ and $R_5$ each represent a hydrogen atom or a non-metallic atomic group required for the formation of a 5-membered or 6-membered ring when $R_1$ and $R_4$ or $R_2$ and $R_5$ are combined together; $L_1$, $L_2$ and $L_3$ each represent a methine group; m represents 0 or 1; n and q each represent 0, 1 or 2; p represents 0 or 1 with the proviso that when p is 0, $R_3$ is a hydroxyl group or a carboxyl group and $R_4$ and $R_5$ are each hydrogen atom; and B' represents a heterocyclic ring containing carboxyl group, a sulfamoyl group or a sulfonamido group.

Each of the compounds represented by formulas (I) to (VI) has at least one dissociation group exhibiting a pK of 4 to 11 in a mixed solution of water and ethanol (1:1 by volume) per molecule.

Compounds represented by formulas (I) to (VI) will be described in more detail below.

Preferred examples of the acid nucleus represented by A or A' include 2-pyrazoline-5-one, rhodanine, hydantoin, thiohydantoin, 2,4-oxazolidinedione, isooxazolidinone, barbituric acid, thiobarbituric acid, indandione, pyrazolopyridine and hydroxypyridone.

Preferred examples of the basic nucleus represented by B include pyridine, quinoline, indolenine, oxazole, benzoxazole, naphthoxazole and pyrrole.

Examples of the heterocyclinc ring represented by B' include pyrrole, indole, thiophene, furan, imidazole, pyrazole, indolizine, quinoline, carbazole, phenothiazine, indoline, thiazole, pyridine, pyridazine, thiadiazine, pyran, thiopyrane, oxadiazole, benzoquinolizine, thiadiazole, pyrrolo-thiazole, pyrrolo-pyridazine and tetrazole.

Any of groups having a dissociation proton which have a pKa (acid dissociation constant) of 4 to 11 in a mixed solution of water and ethanol (1:1 by volume) can be used without particular limitations with regard to types and positions at which the groups are attached to the dye molecules, so long as the dye molecules are substantially water-insoluble at a pH of 6 or lower and are substantially water-soluble at a pH of 8 or higher by the presence of the groups. Preferred examples of the dissociation groups include a carboxyl group, a sulfamoyl group, a sulfonamido group and a hydroxyl group, with a carboxyl group being more preferred. The dissociation group may be bonded directly to the dye molecule, or may be attached to the dye molecule through a bivalent bonding group (e.g., alkylene, phenylene). Examples of the dissociation groups bonded through a bivalent bonding group include 4-carboxyphenyl, 2-methyl-3-carboxyphenyl, 2,4-dicarboxyphenyl, 3,5-di-carboxyphenyl, 3-carboxyphenyl, 2,5-dicarboxyphenyl, 3-ethylsulfamoylphenyl, 4-phenylsulfamoylphenyl, 2-carboxyphenyl, 2,4,6-trihydroxyphenyl, 3-benzenesulfonamidophenyl, 4-(p-diaminobenzenesulfonamido)phenyl, 3-hydroxyphenyl, 2-hydroxyphenyl, 4-hydroxyphenyl, 2-hydroxy-4-carboxyphenyl, 3-methoxy-4-carboxyphenyl, 2-methyl-4-phenylsulfamoylphenyl, 4-carboxybenzyl, 2-carboxybenzyl, 3-sulfamoylphenyl, 4-sulfamoylphenyl, 2,5-disulfamoylphenyl, carboxymethyl, 2-carboxyethyl, 3-carboxypropyl, 4-carboxybutyl and 8-carboxyoctyl.

Preferred examples of the alkyl group represented by R, $R_3$ or $R_6$ are those having from 1 to 10 carbon atoms such as methyl, ethyl, n-propyl, isoamyl and n-octyl.

Preferably, the alkyl group represented by $R_1$ and $R_4$ has from 1 to 20 carbon atoms. Examples of the alkyl group include methyl, ethyl, n-propyl, n-butyl, n-octyl, n-octadecyl, isobutyl and isopropyl. The alkyl group may have one or more substituent groups (e.g., a halogen atom (e.g., chlorine, bromine), a nitro group, a cyano group, a hydroxy group, a carboxyl group, an alkoxy group (e.g., methoxy, ethoxy), an alkoxycarbonyl group (e.g., methoxycarbonyl, i-propoxycarbonyl), an aryloxy group .(e.g., phenoxy), a phenyl group, an amido group (e.g., acetylamino, methanesulfonamido), a carbamoyl group (e.g., methylcarbamoyl, ethylcarbamoyl) and a sulfamoyl group (e.g., methylsulfamoyl, phenylsulfamoyl)).

Preferred examples of the aryl group represented by $R_1$ or $R_2$ include a phenyl group and a naphthyl group. The aryl group may have one or more substituent groups. Examples of the substituent groups include those already described above in the definition of the substituent groups for $R_1$ and $R_2$ and an alkyl group (e.g., methyl, ethyl).

Preferably, the acyl group represented by $R_1$ or $R_2$ has from 2 to 10 carbon atoms. Examples of the acyl group include acetyl, propionyl, n-octanoyl, n-decanoyl, isobutanoyl and benzoyl. Examples of the alkylsulfonyl or arylsulfonyl group represented by $R_1$ or $R_2$ include methanesulfonyl, ethanesulfonyl, n-butanesulfonyl, n-octanesulfonyl, benzenesulfonyl, p-toluenesulfonyl and o-carboxybenzenesulfonyl.

Preferably, the alkoxy group represented by $R_3$ or $R_6$ has from 1 to 10 carbon atoms. Examples of the alkoxy group include methoxy, ethoxy, n-butoxy, n-octoxy, 2-ethylhexyloxy, isobutoxy and isopropoxy. Examples of the halogen atom represented by $R_3$ or $R_6$ include chlorine, bromine and fluorine.

An example of the ring formed by $R_1$ and $R_4$ or $R_2$ and $R_5$ when combined together is a durolysine ring.

Examples of 5-membered or 6-membered rings formed by $R_1$ and $R_2$ when combined together include a piperidine ring, a morpholine ring and a pyrrolidine ring.

The methine group represented by $L_1$, $L_2$ or $L_3$ may be substituted. Examples of substituent groups include methyl, ethyl, cyano, phenyl, chlorine and hydroxypropyl.

X and Y may be the same or different groups and each is an electron attracting group. Examples of the group include a cyano group, a carboxy group, an alkylcarbonyl group which may be substituted (e.g., acetyl, propionyl, heptanoyl, dodecanoyl, hexadecanoyl, 1-oxo-7-chloroheptyl), an arylcarbonyl group which may be substituted (e.g., benzoyl, 4-ethoxycarbonylbenzoyl, 3-chlorobenzoyl), an alkoxycarbonyl group which may be substituted (e.g., methoxycarbonyl, ethoxycarbonyl, butoxycarbonyl, t-amyloxycarbonyl, hexyloxycarbonyl, 2-ethylhexyloxycarbonyl, octyloxycarbonyl, decyloxycarbonyl, dodecyloxycarbonyl, hexadecyloxycarbonyl, octadecyloxycarbonyl, 2-butoxyethoxycarbonyl, 2-methylsulfonylethoxycarbonyl, 2-cyanoethoxycarbonyl, 2-(2-chloroethoxy)ethoxycarbonyl, 2-(2-(2-chloroethoxy)ethoxy)ethoxycarbonyl), an aryloxycarbonyl group which may be substituted (e.g., phenoxycarbonyl, 3-ethylphenoxycarbonyl, 4-ethylphenoxycarbonyl, 4-fluorophenoxycarbonyl, 4-nitrophenoxycarbonyl, 4-methoxyphenoxycarbonyl, 2,4-di-(t-amyl)phenoxycarbonyl), a carbamoyl group which may be substituted (e.g., carbamoyl, ethylcarbamoyl, dodecylcarbamoyl, phenylcarbamoyl, 4-methoxyphenylcarbamoyl, 2-bromophenylcarbamoyl, 4-chlorophenylcarbamoyl, 4-ethoxycarbonylphenylcarbamoyl, 4-propylsulfonylphenylcarbamoyl, 4-cyanophenylcarbamoyl, 3-methylphenylcarbamoyl, 4-hexyloxyphenylcarbamoyl, 2,4-di(t-amyl)phenylcarbamoyl, 2-chloro-3-(dodecyloxycarbamoyl)phenylcarbamoyl, 3-(hexyloxycarbonyl)-phenylcarbamoyl), a sulfonyl group which may be substituted (e.g., methylsulfonyl, phenylsulfonyl) and a sulfamoyl group which may be substituted (e.g., sulfamoyl, methylsulfamoyl).

Examples of the dyes which can be used in the present invention include the following compounds, although the present invention should not be construed as being limited thereto.

I-1

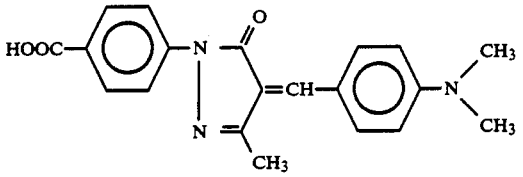

I-2

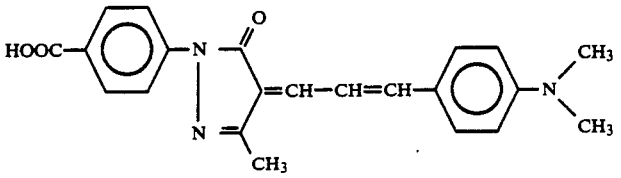

I-3

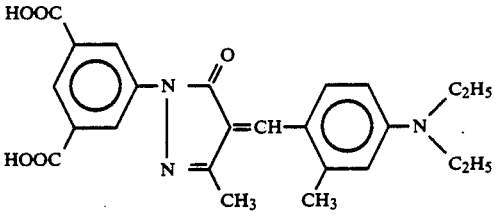

I-4

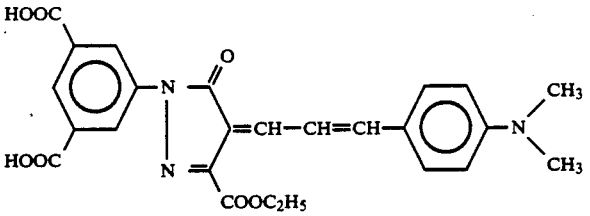

I-5

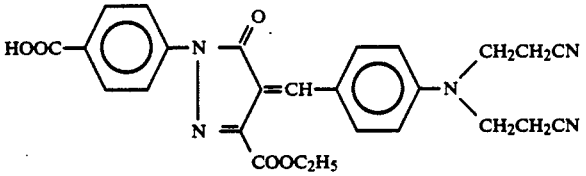

I-6

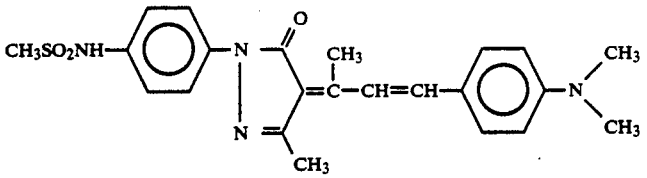

I-7

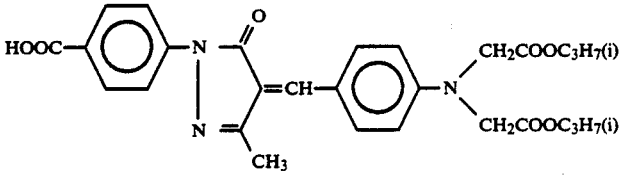

-continued
I-8
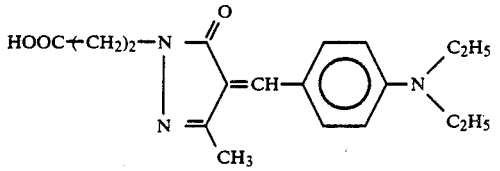
I-9
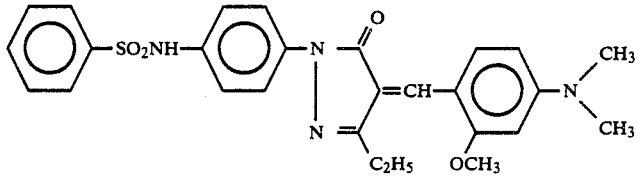
I-10
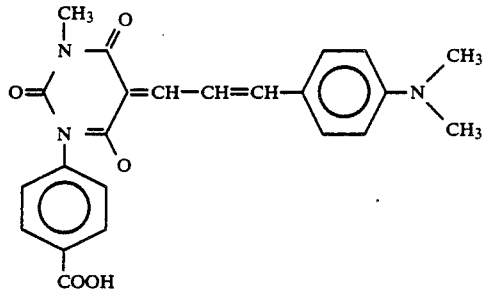
I-11
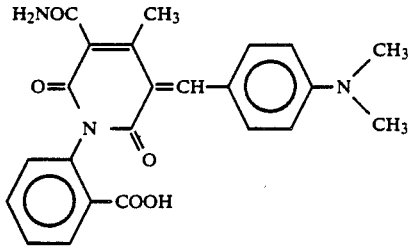
I-12
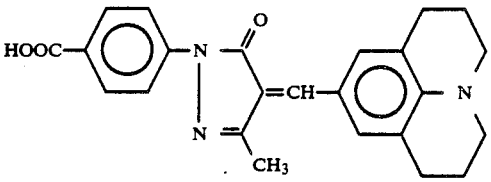
I-13
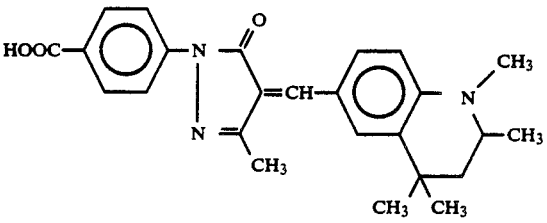
I-14
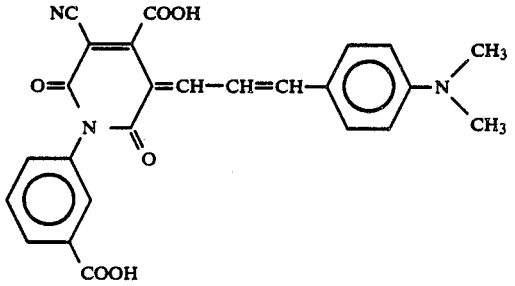

-continued
I-15
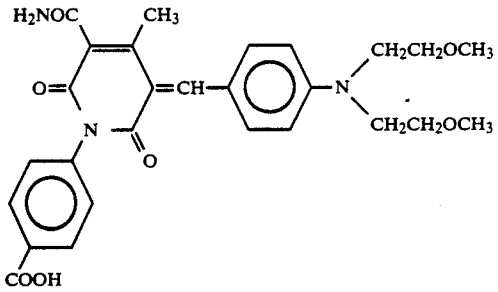
I-16
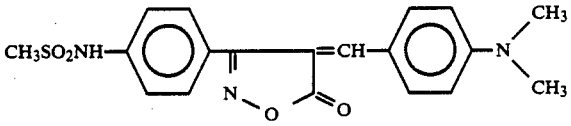
I-17
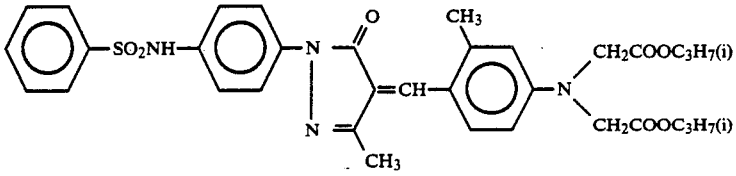
I-18
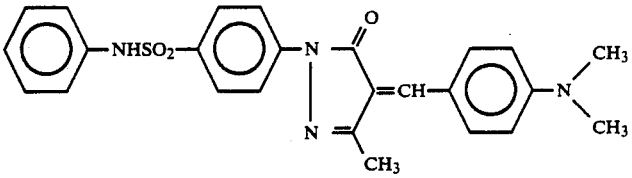
I-19
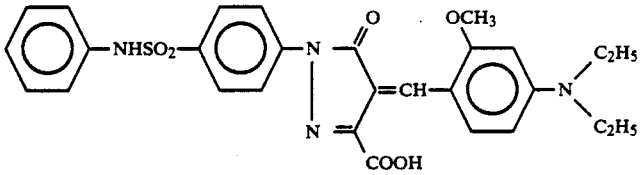
I-20
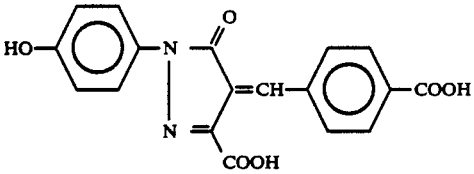
I-21
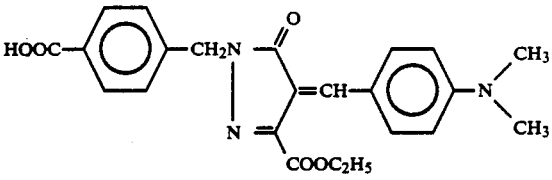
I-22
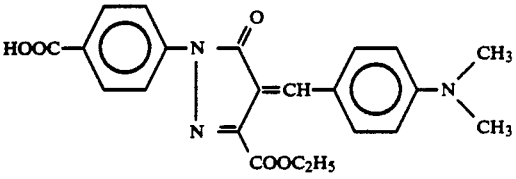

-continued
I-25
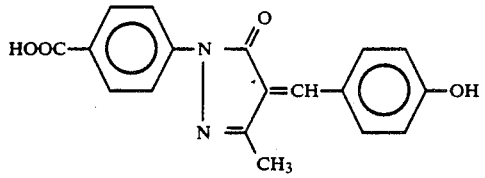
I-26
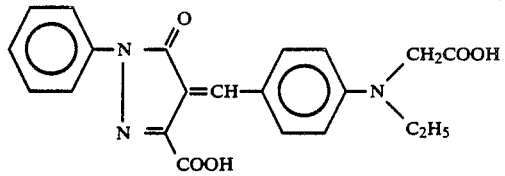
I-27
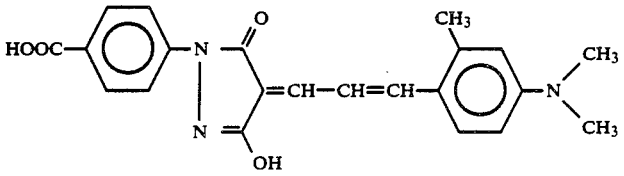
I-28
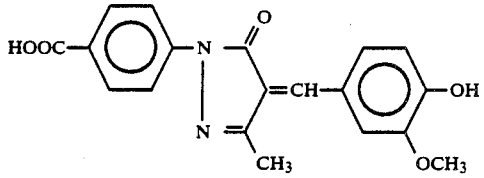
I-29
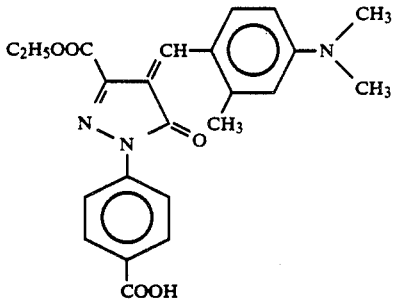
I-30
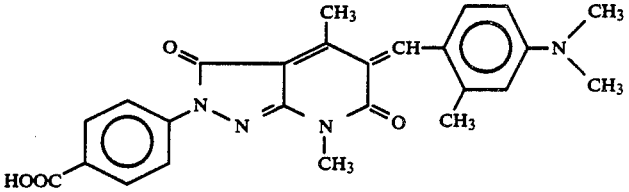
I-31
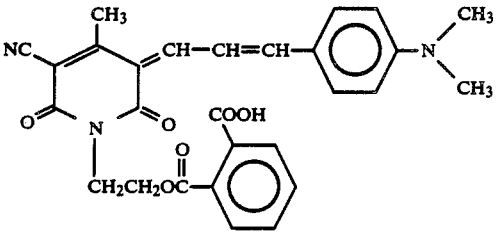

-continued
II-1
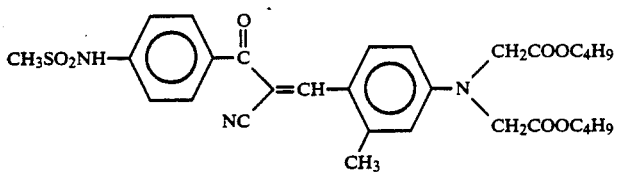
II-2
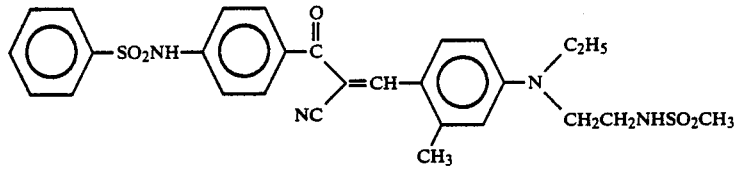
II-3
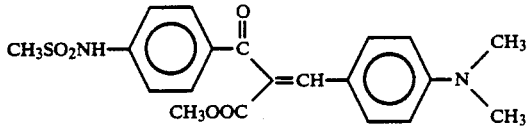
II-4
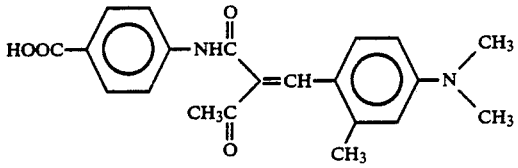
II-5
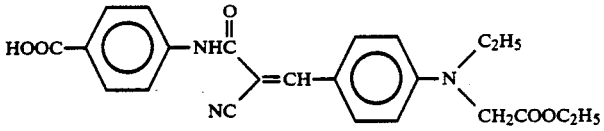
II-6
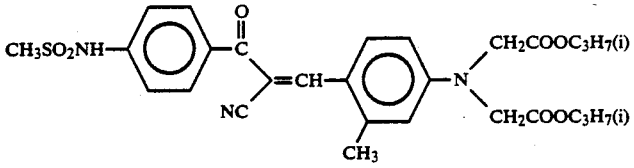
III-1
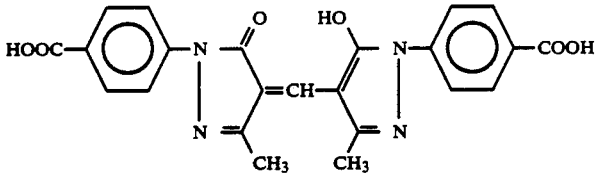
III-2
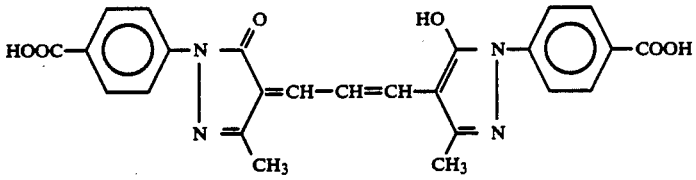
III-3
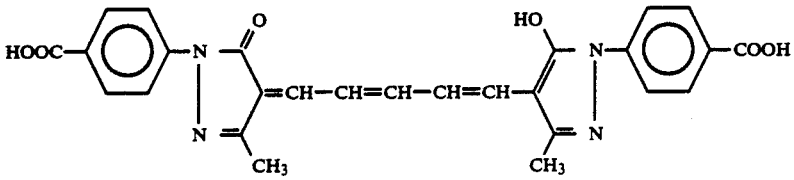

-continued
III-4
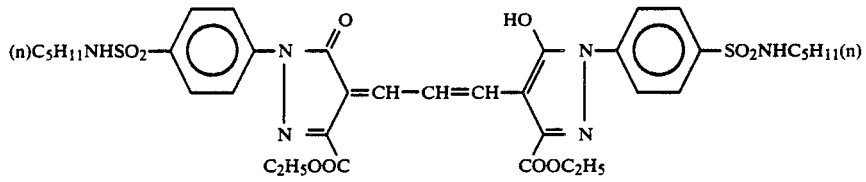
III-5
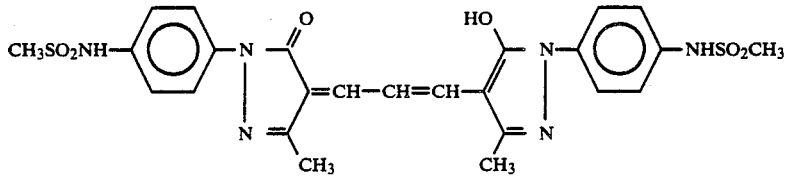
III-6
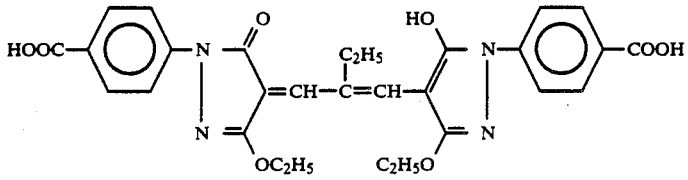
III-7
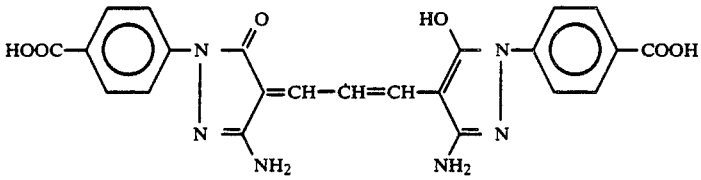
III-8
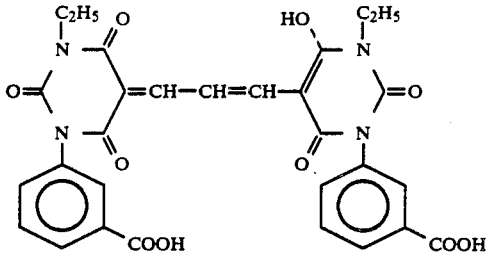
III-9
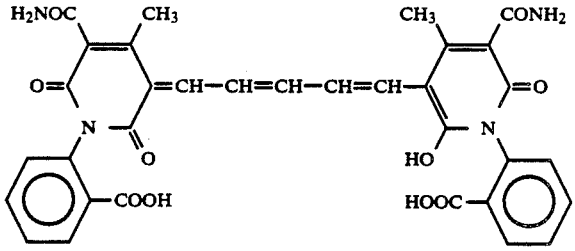
III-10
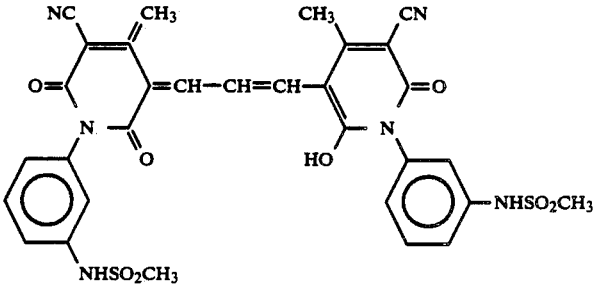

-continued
III-11
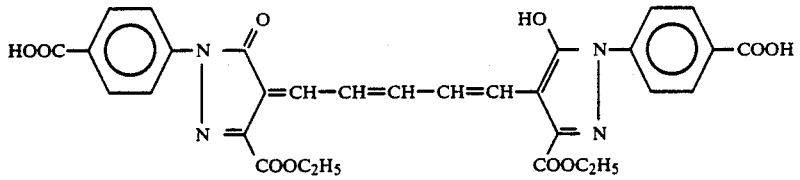
III-12
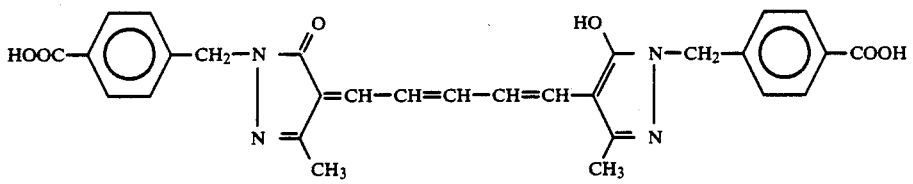
III-13
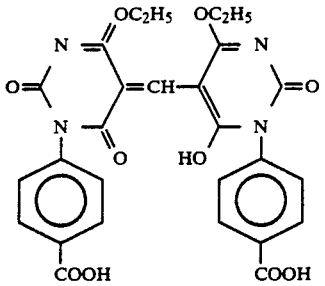
III-14
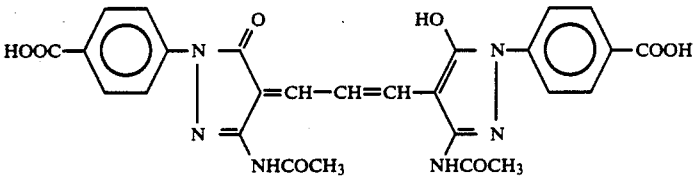
III-15
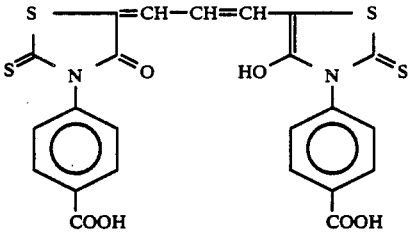
III-16
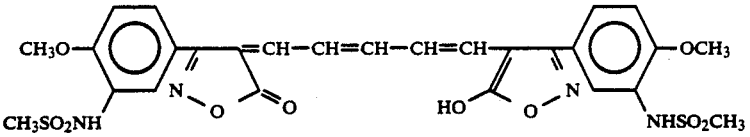
III-17
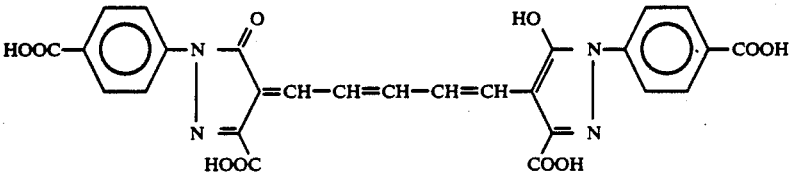

-continued
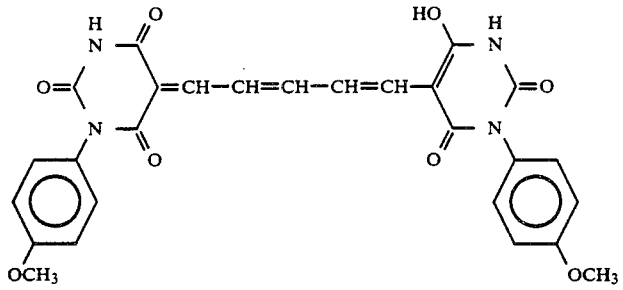
III-18
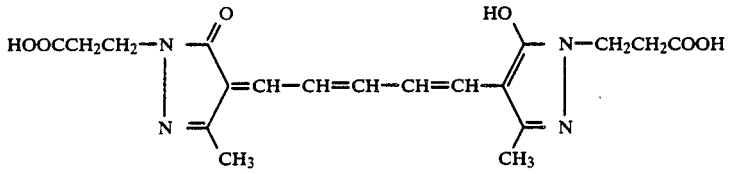
III-19
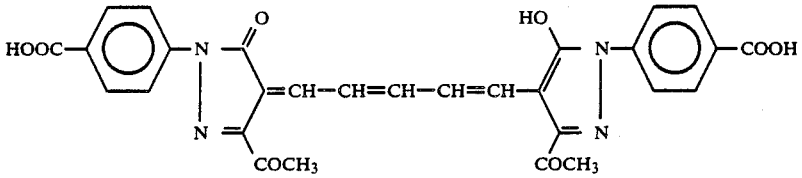
III-20
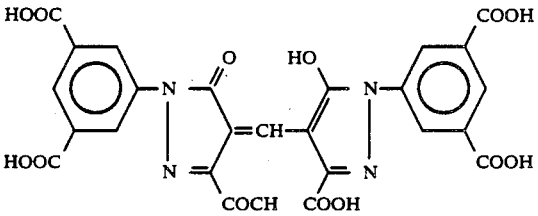
III-21
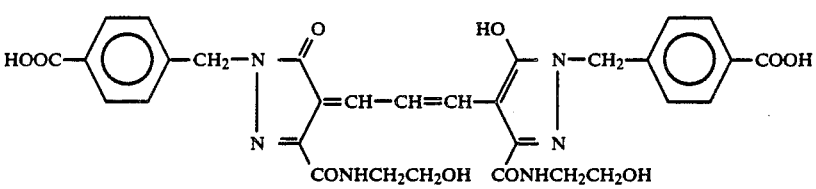
III-22
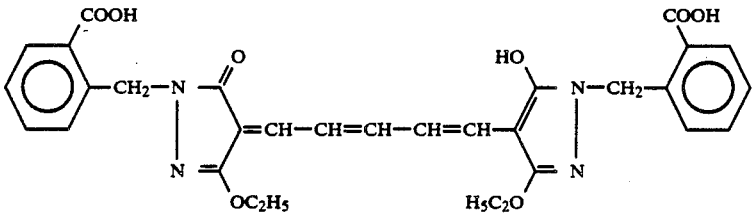
III-23
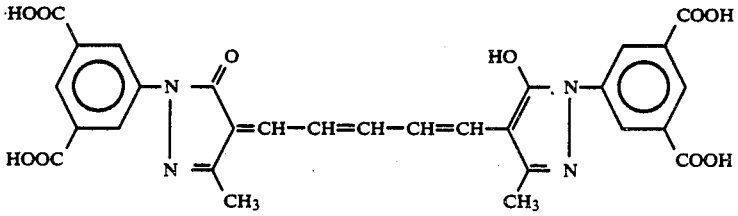
III-24

-continued
III-25
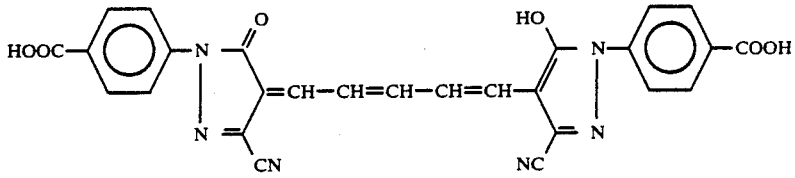
III-26
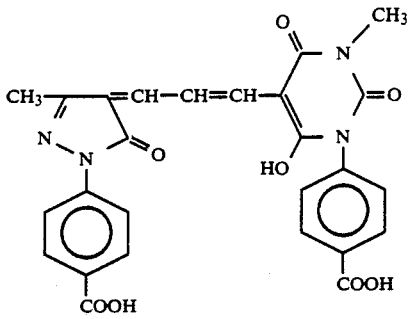
III-27
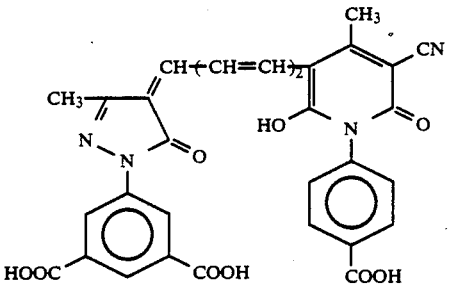
III-28
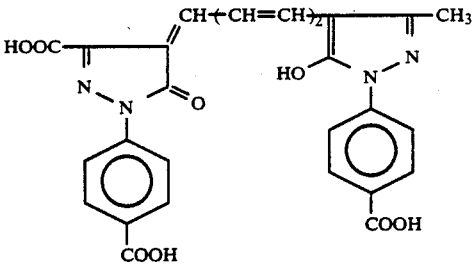
III-29
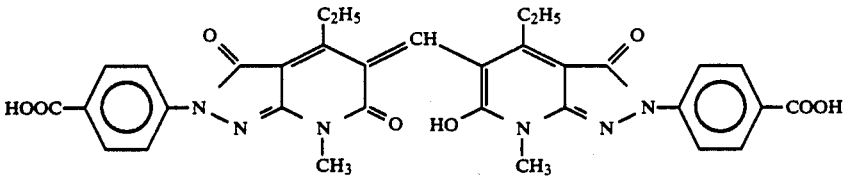
III-30
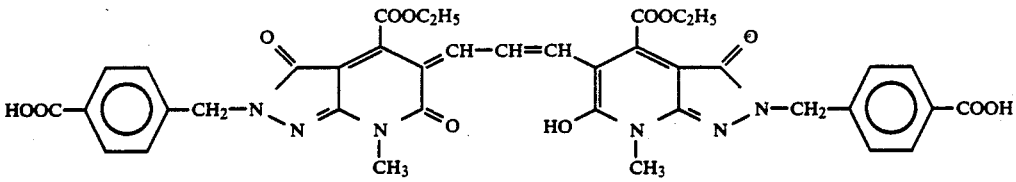
III-31
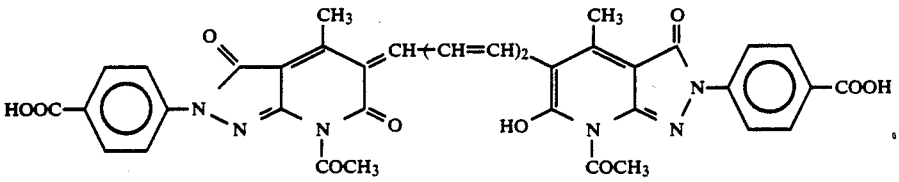

-continued
III-32
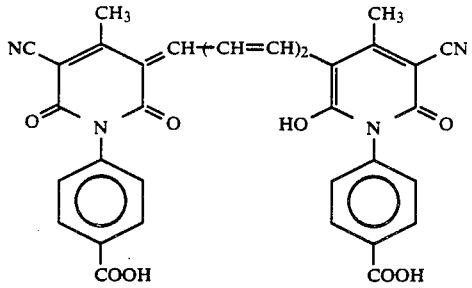
III-33
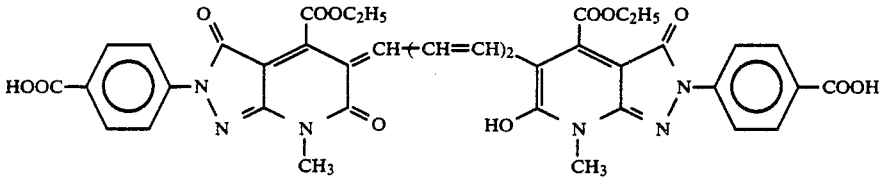
III-34
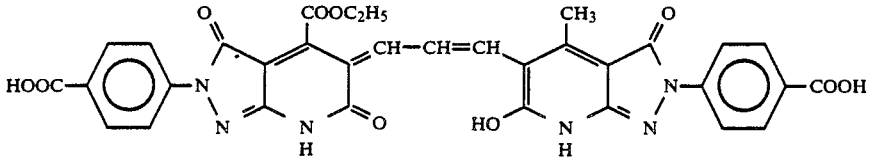
III-35
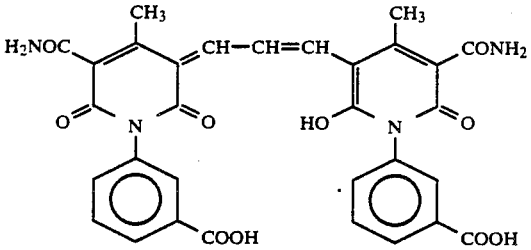
IV-1
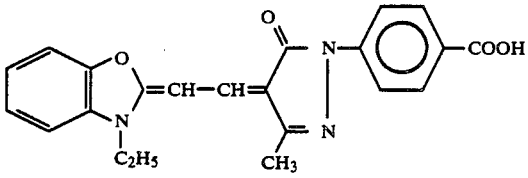
IV-2
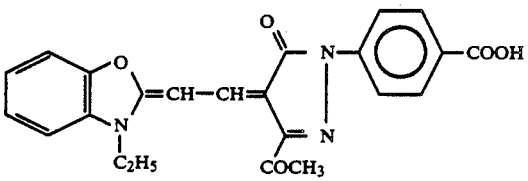
IV-3
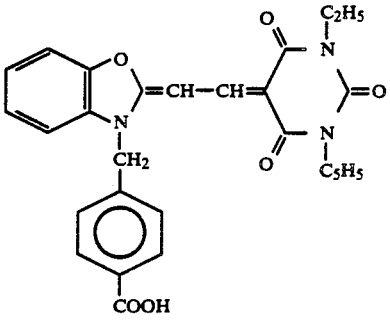

-continued
IV-4
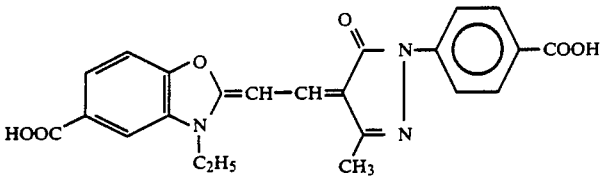
IV-5
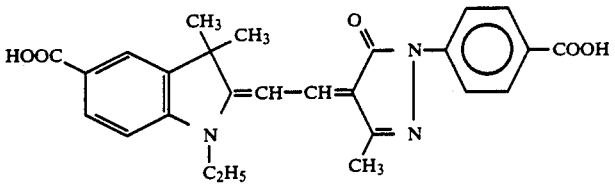
IV-6
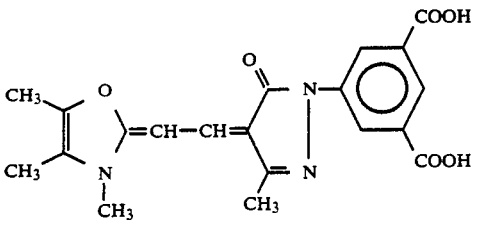
IV-7
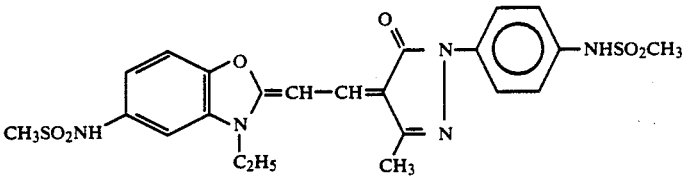
IV-8
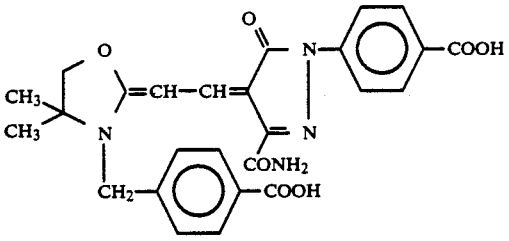
IV-9
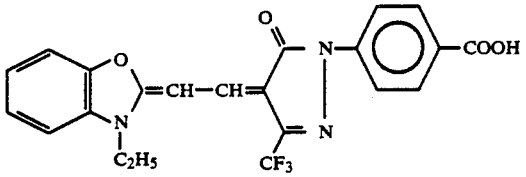
IV-10
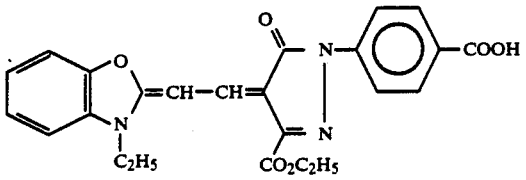

-continued
IV-11
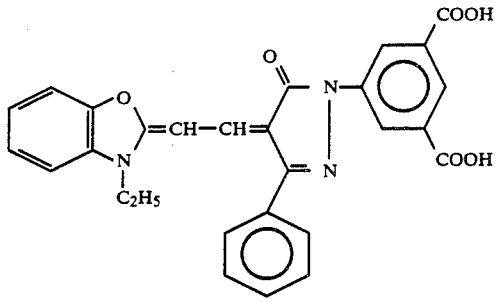
IV-12
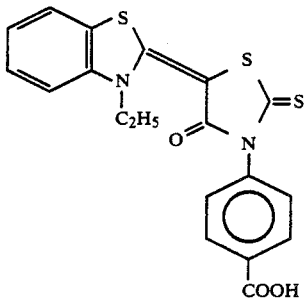
IV-13
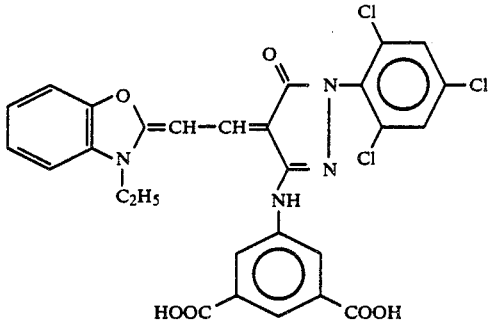
IV-14
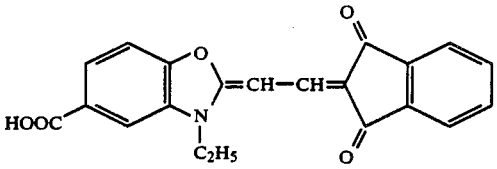
IV-15
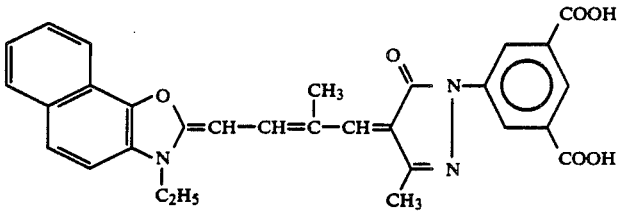
IV-16
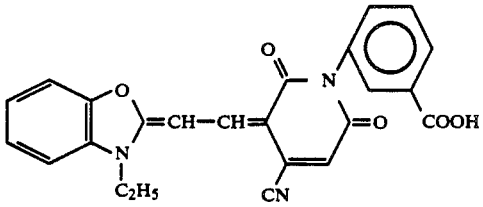

-continued
V-1
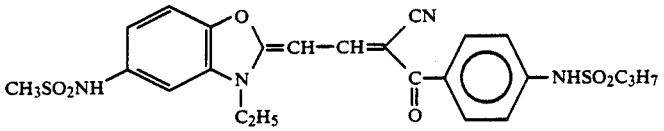
V-2
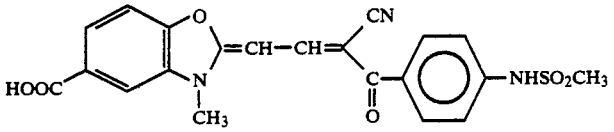
V-3
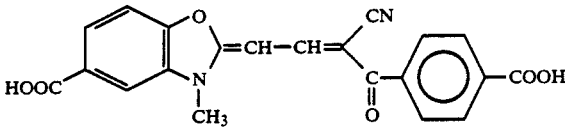
V-4
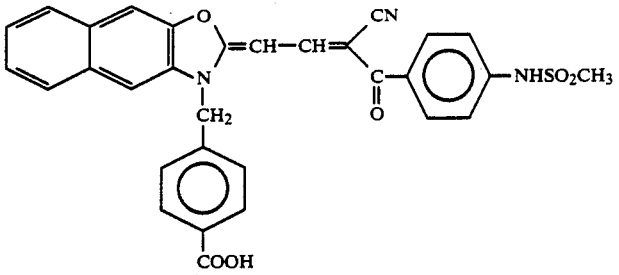
V-5
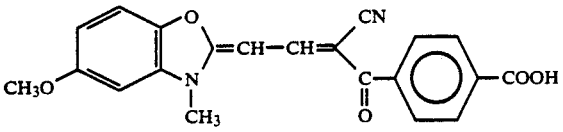
V-6
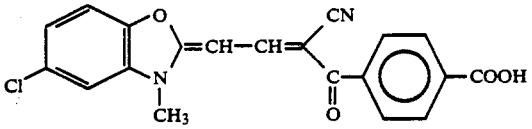
V-7
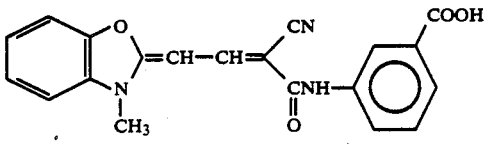
VI-1
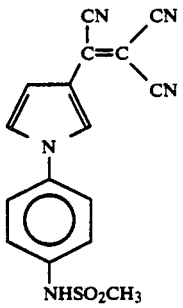

-continued
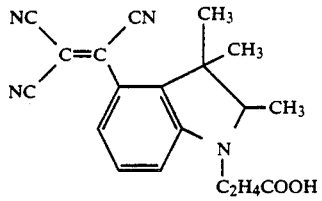
VI-2
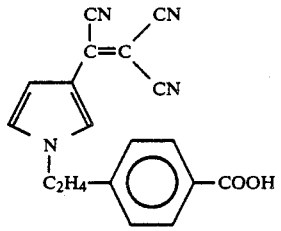
VI-3
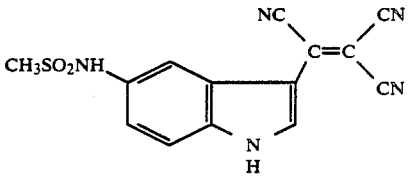
VI-4
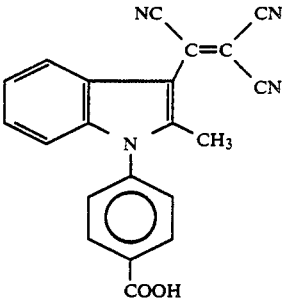
VI-5
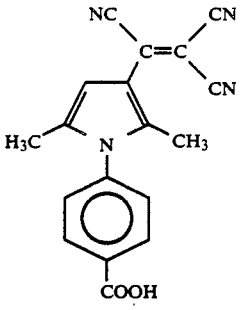
VI-6
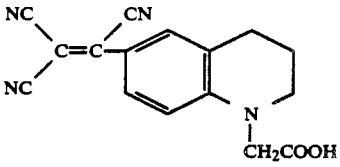
VI-7
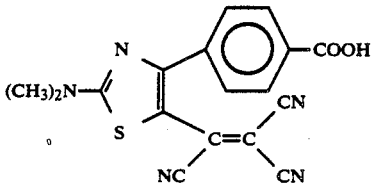
VI-8

-continued

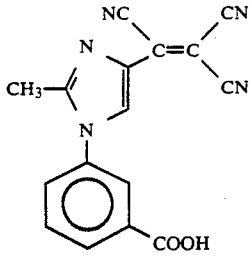

VI-9

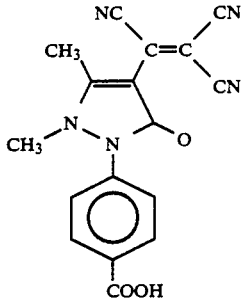

VI-10

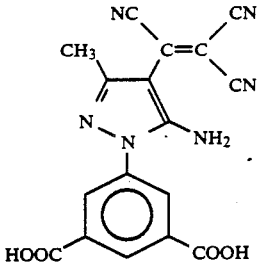

VI-11

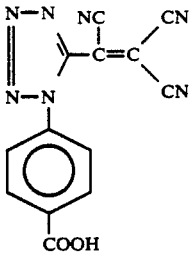

VI-12

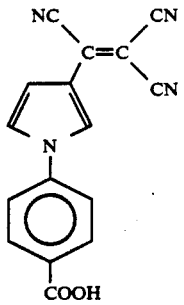

VI-13

As indicated above, dyes which can be used in the present invention are not limited to the above compounds. Other compounds can be used, if desired.

Dyes represented by the formula (I), (III), or (IV) are preferably used in the present invention.

The dye may be preferably used to be dispersed in a solid particle form in a hydrophilic colloid for a colored layer.

The term "solid particle dispersion" or "dispersed in a solid particle form" as used herein means that the solubility of dye itself is low so that the dye cannot exist in a molecular state in hydrophilic colloid for the colored layer, instead, it exists as a solid particle having such a size that it cannot substantially diffuse in the layer.

The solid particle dispersion of the dye can be prepared by the methods described in WO 88/04794, European Patent (EP) 0276566A1 and JP-A-63-197943. Preferred examples thereof include, but are not limited to, a method wherein the dye is crushed in a ball mill and stabilized by a surfactant and gelatin and a method wherein the dye is dissolved in an alkaline solution and the pH of the solution is lowered to precipitate it out. The method using a ball mill is preferable.

When the dye is incorporated in the colored layer as in the present invention, the coating weight of hydrophilic colloid in the colored layer is preferably from 0.05 to 0.5 g/m$^2$. Accordingly, the particle size which is incorporated in the colored layer is limited to a certain size. When particles having a size not smaller than 3 μm are contained in the layer, problems results in which that dye particles come out of the colored layer, etc. Accordingly, the particle size of the dye is generally from 0.005 μm to 3 μm, preferably from 0.005 μm to 1 μm, more preferably from 0.005 μm to 0.5 μm.

The large-size particles can be removed by filtration, centrifugation and other conventional methods.

The dyes are used in an amount of prefrably from 5 to 400 mg/m$^2$, more preferably from 10 to 250 mg/m$^2$.

Hydrophilic colloid for the preparation of the solution (coating composition) for the colored layer may be used so that an amount ratio by weight of a dye to a hydrophilic colloid is generally not more than 2, preferably from 0.01 to 1.

The amount of hydrophilic colloid used in the colored layer is preferably from 0.05 to 0.5 g/m$^2$, more preferably from 0.05 to 0.4 g/m$^2$.

When the total amount of hydrophilic colloid on one side of a support is too large, the amount of water contained in the layers in developing solutions increases, and dryness is deteriorated. Accordingly, such a large amount of colloid is not preferred. The entire coating weight of hydrophilic colloid on each side of a support is preferably from 0.5 to 3 g/m$^2$, more preferably from 0.5 to 2.8 g/m$^2$.

The pH of coating compositions comprising hydrophilic colloid for the colored layer, overcoat layer, emulsion layer, surface protective layer, etc. are adjusted to preferably from 5 to 7 by adding suitable amounts of acidic solution (e.g., phosphoric acid, citric acid, and hydrochloric acid, etc.), or alkali solution (e.g., sodium hydroxide, etc.).

A preferred example of a hydrophilic colloid for the colored layer and the second undercoat layer is gelatin. A more preferred example is acid-processed gelatin. However, any conventional hydrophilic colloid can be used.

Preferred examples of silver halide emulsions which can be used in the present invention include silver bromide, silver iodobromide, silver iodochlorobromide, silver chlorobromide and silver chloride.

The pH of silver halide emulsion is adjusted to preferably from 5 to 7, more preferably from 5.5 to 6.5 by adding suitable amounts of acidic solution (e.g., phosphoric acid, citric acid, and hydrochloric acid, etc.), or alkali solution (e.g., sodium hydroxide, etc.).

The silver halide grains of the present invention may have a regular crystal form, such as a cube or octahedron, an irregular crystal form, such as sphere or tube (plate form), or a composite form of these crystal forms. A mixture of grains having various crystal forms can be used, but grains having a regular crystal form are preferably used.

The silver halide grains of the present invention may have different phases in the interiors of the grains and in the surface layers thereof, or may be composed of a uniform phase. Grains where a latent image is mainly formed on the surface thereof (e.g., negative type emulsion) as well as grains where a latent image is mainly formed in the interior thereof (e.g., internal latent image type emulsion, a previously fogged direct reversal type emulsion) can be used. Grains where a latent image is mainly formed on the surface thereof are preferred.

The silver halide emulsions of the present invention are preferably tubular (plate form) grain emulsion wherein grains having a thickness of not larger than 0.5 μm, preferably not larger than 0.3 μm, a diameter of not smaller than 0.6 μm and an aspect ratio of not lower than 5 account for at least 50% of the entire projected area of grains, or a monodisperse emulsion having a coefficient of variation in grain size distribution (a value $S/\bar{d}$ obtained by dividing standard deviation S by diameter $\bar{d}$ represented by the diameter when the projected area is considerd to be a circle) of not more than 20%. Two or more tubular grain emulsions and monodisperse emulsions may be mixed.

The photographic emulsions of the present invention can be prepared by the methods described in P. Glafkides, *Chimie et Physique Photographique*, Paul Montel (1967), G. F. Dufffin, *Photographic Emulsion Chemistry*, Focal Press (1966) and V. L. Zelikman et al., *Making and Coating Photographic Emulsion*, Focal Press (1964).

Solvents for silver halide may be used during the formation of silver halide grains to control the growth of the grains. Examples of the solvents include ammonia, potassium rhodanide, ammonium thiocyanate, thioether compounds (described in U.S. Pat. Nos. 3,574,628, 3,704,130, 4,297,439 and 4,276,374), thione compounds (described in JP-A-53-144319, JP-A-53-82408 and JP-A-55-77737) and amine compounds (described in JP-A-54-100717).

Cadmium salts, zinc salts, thallium salts, iridium salts or complex salts thereof, rhodium salts or complex salts thereof, or iron salts or complex salts thereof may coexist during the formation of silver halide grains or the physical ripening thereof.

Gelatin is preferably used as a binder or colloid for the emulsion layers, surface protective layers, and interlayers of the photographic material. However, other hydrophilic colloids can be used. Examples of the hydrophilic colloid include protein such as gelatin derivatives, graft polymers of gelatin with other high-molecular materials, albumin and casein; cellulose derivatives such as hydroxyethyl cellulose, carboxymethyl cellulose and cellulose sulfate; saccharide derivatives such as sodium alginate and starch derivative; and synthetic hydrophilic high-molecular materials such as polyvinyl alcohol, polyvinyl alcohol partial acetal, poly-N-vinylpyrrolidone, polyacrylic acid, polymethacrylic acid, polyacrylamide, polyvinylimidazole, polyvinyl pyrazole and copolymers of the monomers of these polymers.

Examples of gelatin include lime-processed gelatin, acid-processed gelatin, enzyme-processed gelatin [as described in *Bull. Soc. Sci. Japan*, No. 16, page 30 (1966)] and hydrolyzate of gelatin.

Hydrophilic colloid layers which constitute the sensitive layers or back layers of the photographic material of the present invention may optionally contain inorganic or organic hardening agents. Examples of the hardening agents include chromium salt, aldehydes (e.g., formaldehyde, glyoxal, glutaraldehyde) and N-methylol compounds (e.g., dimethylol urea). Active halogen compounds (e.g., 2,4-dichloro-6-hydroxy-1,3,5-triazine and sodium salt thereof) and active vinyl compounds (e.g., 1,3-bisvinylsulfonyl-2-propanol, 1,2-bis(- vinylsulfonylacetamido) ethane, bis(vinylsulfonylmethyl) ether or vinyl polymers having a vinylsulfonyl group on the side chain thereof) are preferred, because hydrophilic colloids such as gelatin can be rapidly cured and stable photographic characteristics can be obtained. N-Carbamoyl pyridinium salts (e.g., 1-morpholinocarbonyl-3-pyridinio)methanesulfonate) and halo amidinium salts (e.g., 1-(1-chloro-1-pyridinomethylene)pyrrolidinium 2-naphthalenesulfonate) are excellent compounds having a high curing rate.

The silver halide emulsions of the present invention may be spectrally sensitized with methine dyes, etc. Examples of sensitizing dyes include cyanine dyes, merocyanine dyes, complex merocyanine dyes, holopolar cyanine dyes, hemicyanine dyes, styryl dyes and hemioxonol dyes. Particularly useful dyes are cyanine dyes, merocyanine dyes and complex merocyanine dyes. Any of nuclei which are generally used as basic heterocyclic nucleuses for cyanine dyes can be applied to these dyes. Examples of the nuclei include a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus; nuclei formed by fusing alicyclic hydrocarbon rings to these nuclei; and nuclei formed by fusing aromatic hydrocarbon rings to these nuclei such as an indolenine nucleus, a benzindolenine nucleus, an indole nucleus, a benzoxazole nucleus, a naphthoxazole nucleus, a benzthiazole nucleus, a naphthothiazole nucleus, a benzselenazole nucleus, a benzimidazole nucleus and a quinoline nucleus. These nuclei may have one or more substituent groups on the carbon atoms thereof.

5-Membered or 6-membered heterocyclic nuclei such as a pyrazoline-5-one nucleus, a thiohydantoin nucleus, a 2-thiooxazolidine-2,4-dione nucleus, a thiazolidine-2,4-dione nucleus, a rhodanine nucleus and a thiobarbituric acid as nuclei having a keto-methylene structure can be applied to merocyanine dyes or complex merocyanine dyes.

These sensitizing dyes may be used either alone or in a combination of two or more. Combinations of the sensitizing dyes are often used for the purpose of supersensitization. In addition to the sensitizing dyes, the emulsions may contain dyes which themselves do not have a spectral sensitization effect or substances which do substantially not absorb visible light but have a supersensitization effect. For example, the emulsions may contain nitrogen-containing heterocyclic group-substituted aminostilbene compounds (as described in U.S. Pat. Nos. 2,933,390 and 3,635,721), condensates of formaldehyde with aromatic organic acids (as describe in U.S. Pat. No. 3,743,510), cadmium salts and azaindene compounds. Combinations described in U.S. Pat. Nos. 3,615,613, 3,615,641, 3,617,291 and 3,635,721 are particularly useful.

The silver halide photographic emulsions of the present invention may contain various compounds for the purpose of preventing fogging during the course of the production, storage or processing of the photographic materials or for the purpose of stabilizing photographic performance. For example, azoles such as benzthiazolium salts, nitroimidazoles, nitrobenzimidazoles, chlorobenzimidazoles, bromobenzimidazoles, mercaptothiazoles, mercaptobenzthiazoles, mercaptobenzimidazoles, mercaptothiadiazoles, aminotriazoles, benztriazoles, nitrobenztriazoles and mercaptotetrazoles (particularly, 1-phenyl-5-mercaptotetrazole); mercaptopyrimidines; mercaptotriazines; thioketo compounds such as oxazolinethione; azaindenes such as triazaindene, tetraazaindenes (particularly 4-hydroxy-substituted (1,3,3a,7)tetraazaindenes) and pentaazaindenes; and benzenethiosulfonic acid, benzenesulfinic acid and benzenesulfonamide can be added as anti-fogging agents or stabilizers.

The photographic materials of the present invention may contain one or more surfactants as coating aid or for the purpose of imparting antistatic properties, improving slipperiness and photographic characteristics (e.g., development acceleration, high-contrast, sensitization), facilitating emulsification and preventing sticking.

The hydrophilic colloid layers of the photographic materials of the present invention may contain water-soluble dyes as filter dyes or for the purpose of preventing irradiation or halation. Examples of such dyes include oxonol dyes, hemioxonol dyes, styryl dyes, merocyanine dyes, anthraquinone dyes and azo dyes. In addition thereto, cyanine dyes, azomethine dyes, triarylmethane dyes and phthalocyanine dyes are useful. Oil-soluble dyes may be emulsified by means of an oil-in-water dispersion method and then added to the hydrophilic colloid layers.

The present invention can be applied to multi-layer color photographic materials comprising a support having thereon at least emulsion layers having different spectral sensitivity. Multi-layer color photographic materials comprise generally at least one red-sensitive emulsion layer, at least one green-sensitive emulsion layer and at least one blue-sensitive emulsion layer provided on a support. The order of the arrangement of these layers may be varied. Preferably, these layers are arranged from the side of the support in the order of red-sensitive layer, green-sensitive layer and blue-sensitive layer, in the order of blue-sensitive layer, green-sensitive layer and red-sensitive layer, or in the order of blue-sensitive layer, red-sensitive layer and green-sensitive layer. If desired, a given emulsion layer may be composed of two or more emulsion layers having the same color sensitivity or different color sensitivity to improve the level of sensitivity which can be attained, or it may be composed of three layers to improve graininess. A non-sensitive layer may be interposed between two or more emulsion layers having the same color sensitivity. Further, an emulsion layer may be inserted between two emulsion layers having the same color sensitivity, the inserted emulsion layer having a different color sensitivity from that of the two emulsion layers having the same color sensitivity. A reflection layer may be provided under a high-sensitivity layer, particularly a high-sensitivity blue-sensitive layer.

Generally, a cyan color forming coupler is incorporated in the red-sensitive layer, a magenta color forming coupler is incorporated in the green-sensitive layer and a yellow color forming coupler is incorporated in the blue-sensitive layer. If desired, different combinations may be used. For example, a combination of an infrared-sensitive layer therewith may be used for quasi-color photographs or exposure to semiconductor layers.

The support can be coated with photographic emulsion layers or other hydrophilic layers by conventional coating methods such as a dip coating method, a roller coating method, a curtain coating method, an extrusion coating method and a bar coating method. If desired, the support may be simultaneously coated with multiple layers by the coating methods described in U.S. Pat. Nos. 2,681,294, 2,761,791, 3,526,528 and 3,508,947.

The present invention can be applied to various color and black-and-white photographic materials. Typical examples of materials to which the present invention can be applied include general-purpose and movie color negative films, reversal color films for slides and television, color paper, color positive films and reversal color paper, diffusion transfer type color photographic materials and heat developing photosensitive materials. The present invention can also be applied to black-and-white sensitive materials for X-rays by utilizing tricolor coupler mixtures described in *Research Disclosure,* No. 17123 (July 1978) or black color forming couplers described in U.S. Pat. No. 4,126,461 and U.K. 2,102,136. Further, the present invention can be applied to films for plate making such as lith film and scanner film, direct or indirect medical or industrial X-ray films, negative black and white films for photography, black and white photographic paper, microfilms for COM, general-purpose microfilms, silver salt diffusion transfer type sensitive materials and printing-out type sensitive materials.

When the photographic element of the present invention is applied to color diffusion transfer type photography, the film unit may be a peel apart type structure, an integrated type structure as described in JP-B-46 16356, JP-B-48-33697, JP-A-50-13040 and U.K. Patent 1,330,524, or a non-peeling type structure described in JP-A-57-119345.

For widening the processing temperature range, that a polymer acid layer protected by a neutral timing layer is preferably used in the format of any of the above-listed types of structures. When color diffusion transfer type photography is used, the polymer acid may be used in any of the layers of the sensitive material, or it may be contained as a component of a developing solution.

Various exposure means can be applied to the photographic materials of the present invention. Light sources which emit radiation or light corresponding to the sensitive wavelengths of the photographic materials can be used as lighting sources or writing light sources. Natural light (sunlight), incandescent electric lamps, halogen lamps, mercury vapor lamps, fluorescent lamps and flash-light sources such as strobe and metal combustion flash bulbs are generally used. Gas, dye solution or semiconductor laser which emit light in the wavelength region of from ultraviolet light to infrared rays, light-emitting diodes and plasma light sources can be used as recording light sources. Further, other exposure means which can be used include those composed of a combination of linear or planar light sources with a micro-shutter array which utilizes lanthanum-doped lead titanyl zirconate (PLZT), a liquid crystal display (LCD) or a fluorescent screen (e.g., CRT, fluorescent intensifying screen) which emits fluorescence when phosphors are excited by electron beams or X-rays. If desired, spectral distribution for exposure may be controlled by means of a color filter.

The photographic materials of the present invention can be processed by conventional methods and processing solutions described in *Research Disclosure,* No. 176, pages 28–30 (RD 17643). The processing may be either photographic processing which forms silver images (black-and-white photographic processing) or photographic processing which forms dye images (color photographic processing). The processing temperature is generally in the range of 18° to 50° C.

Developing solutions for use in carrying out black-and-white photographic processing may contain conventional developing agents. Examples of the developing agents include dihydroxybenzenes (e.g., hydroquinone), 3-pyrazolidones (e.g., 1-phenyl-3-pyrazolidone) and aminophenols (e.g., N-methyl-p-aminophenol). These developing agents may be used either alone or in combination. The developing solutions contain generally known preservatives, alkaline agents, pH buffering agents and anti-fogging agents optionally together with dissolution aids, color toning agents, development accelerators (e.g., quaternary salt, hydrazine, benzyl alcohol), surfactants, anti-foaming agents, water softeners, hardening agents (e.g., glutaraldehyde) and tackifiers.

Any development methods which form silver salt images by conventional reversal development can be used for the black-and-white photographic processing of the photographic material of the present invention. Conventional processing solutions can be used. The processing temperature is generally in the range of 18° to 65° C., but a temperature lower than 18° C. or higher than 65° C. may be used.

Reversal development comprises generally the following stages.

First development—rinse—bleaching—cleaning—whole surface exposure—second development—fixing—rinse—drying.

Developing solutions for use in the black and white photographic processing of the first development may contain conventional developing agents. Examples of the developing agents include dihydroxybenzenes (e.g., hydroquinone), 3-pyrazolidones (e.g., 1-phenyl-3-pyrazolidone), aminophenols (e.g., N-methyl-p-aminophenol), 1-phenyl-3-pyrazolines, ascorbic acid and heterocyclic compounds like condensates of 1,2,3,4-tetrahydroquinolines with an indolene ring (as described in U.S. Pat. No. 4,067,872). These compounds may be used either alone or in combination. Particularly, combinations of dihydroxybenzenes with pyrazolidones and/or aminophenols are preferred. Generally, the developing solutions contain conventional preservatives, alkaline agents, pH buffering agents and anti-fogging agents optionally together with dissolution aids, color toning agents, development accelerators, surfactants, anti-foaming agents, water softeners, hardening agents and tackifiers. The photographic material of the present invention is processed with developing solutions containing sulfite ions as a preservative in an amount of at least 0.15 mol/l.

The pH of the first developing solution is preferably from 8.5 to 11, more preferably from 9.5 to 10.5.

The first developing solution contains a solvent for silver halide, such as NaSCN in an amount of 0.5 to 6 g/l.

Conventional black-and-white developing solutions can be used as the second developing solution. Namely, the second developing solution has a composition obtained by removing the solvent for silver halide from the first developing solution. The pH of the second developing solution is preferably from 9 to 11, more preferably from 9.5 to 10.5.

Potassium dichromate or cerium sulfate is used as the bleaching solution.

Thiosulfates or thiocyanates are used in the fixing solutions. If desired, the fixing solutions may contain water-soluble aluminum salts.

As a specific embodiment of the development step, a method may be used wherein the developing agent is incorporated in the photographic material (e.g., in the emulsion layers) and the photographic material is processed in an aqueous alkaline solution to carry out development. Among the developing agents, hydrophobic compounds can be incorporated in the emulsion layers by the methods described in *Research Disclosure* No. 169 (RD-16928), U.S. Pat. No. 2,739,890, U.K. Patent 813,253 or West German Patent 1,547,763.

Fixing solutions having conventional compositions can be used. Thiosulfates and thiocyanates as well as organosulfur compounds which are known as effective fixing agents can be used as fixing agents. The fixing solutions may contain water-soluble aluminum salts as hardening agents.

Color developing solutions which can be used for the development of the photographic materials of the present invention are preferably aqueous alkaline solutions mainly composed of aromatic primary amine color developing agents. Aminophenol compounds are useful as the color developing agents and p-phenylenediamine compounds are preferred as the color developing agents. Typical examples thereof include 3-methyl-4-amino N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline and salts thereof such as sulfate, hydrochloride and p-toluenesulfonate. These diamines are preferably used in the form of salts, because the salts are generally more stable than their free forms.

These compounds may be used either alone or in combination of two or more.

Generally, the color developing solutions contain pH buffering agents such as alkali metal carbonates, borates and phosphates, restrainers such as bromides, iodides, benzimidazoles, benzothiazoles and mercapto compounds, and anti-fogging agents.

Generally, the color developing solutions contain pH buffering agents and anti-fogging agents. If desired, the color developing solutions may optionally contain preservatives such as hydroxylamines, dialkylhydroxylamines, hydrazines, triethanolamine, triethylenediamine and sulfites; organic solvents such as ethylene glycol and diethylene glycol; development accelerators such as benzyl alcohol, polyethylene glycol, quaternary ammonium salts and amines; nucleating agents such as color forming couplers, competitive couplers and sodium boron hydride; auxiliary developing agents such as 1-phenyl-3-pyrazolidone; tackifiers; and chelating agents such as polyaminocarboxylic acids, polyaminophosphonic acids, alkylphosphonic acids and phosphonocarboxylic acids; and antioxidants described in West German Patent Application (OLS) No. 2,622,950.

Generally, when reversal processing is conducted, black-and-white development is first carried out and color development is then carried out. Black-and-white developing solutions may contain conventional developing agents such as dihydroxybenzenes (e.g., hydroquinone), 3-pyrazolidones (e.g., 1-phenyl-3-pyrazolidone) and aminophenols (e.g., N-methyl-p-aminophenol). These developing agents may be used either alone or in combination of two or more.Black-and-white developing agents may be used either alone or in combination.

Any photographic developing methods used in addition to the color developing solutions may be applied to the photographic materials of the present invention. Examples of the developing agents which can be used in the developing solutions include dihydroxybenzene developing agents, 1-phenyl-3-pyrazolidone developing agents and p-aminophenol developing agents. These compounds may be used either alone or in combination (e.g., combinations of 1-phenyl-3-pyrazolidone with dihydroxybenzenes or combinations of p-aminophenols with dihydroxybenzenes). The photographic materials of the present invention may be processed with infectious developing solutions containing a sulfite ion buffer such as carbonyl sulfite and hydroquinone.

Examples of the dihydroxybenzene developing agents include hydroquinone, chlorohydroquinone, bromohydroquinone, isopropylhydroquinone, toluhydroquinone, methylhydroquinone, 2,3-dichlorohydroquinone and 2,5-di-methylhydroquinone. Examples of the 1-phenyl-3-pyrazolidone developing agents include 1-phenyl-3-pyrazolidone, 4,4-dimethyl-1-phenyl-3-pyrazolidone, 4-hydroxymethyl-4'-methyl-1-phenyl-3-pyrazolidone and 4,4-dihydroxymethyl-1-phenyl-3-pyrazolidone. Examples of the p-aminophenol developing agents include p-aminophenol and N-methyl-p-aminophenol.

The developing solutions contain preservatives such as compounds that provide free sulfite ion (e.g., sodium sulfite, potassium sulfite, potassium metabisulfite and sodium metabisulfite). When the infectious developing solutions are used, formaldehyde sodium bisulfate, which scarcely forms free sulfite ion may be used.

Examples of alkaline agents for use in the developing solutions of the present invention include potassium hydroxide, sodium hydroxide, potassium carbonate, sodium carbonate, sodium acetate, potassium tertiary phosphate, diethanolamine and triethanolamine. The pH of the developing solution is generally set to 8.5 or higher, preferably 9.5 or higher.

The developing solutions may contain organic compounds which are known as anti-fogging agents or restrainers. Examples of the anti-fogging agents or the restrainers include azoles such as benzthiazolium salts, nitroindazoles, nitrobenzimidazoles, chlorobenzimidazoles, bromobenzimidazoles, mercaptothiazoles, mercaptobenzthiazoles, mercaptobenzimidazoles, mercaptothiadiazoles, aminotriazoles, benztriazoles, nitrobenztriazoles and mercaptotetrazoles (particularly, 1-phenyl-5-mercaptotetrazole); mercaptopyrimidines; mercaptotriazines; thioketo compounds such as oxazolinethione; azaindenes such as triazaindenes, tetraazaindenes (particularly 4-hydroxy-substituted (1,3,3a,7)tetraazaindene) and pentaazaindenes; and benzenethiosulfonic acid, benzenesulfinic acid, benzenesulfonamide and sodium 2-mercaptobenzimidazole-5-sulfonate.

The developing solutions of the present invention may contain polyalkylene oxides, such as polyethylene oxide having a molecular weight of 1,000 to 10,000 in an amount of 0.1 to 10 g/l as a restrainer.

Examples of water softeners which can be used in the developing solutions of the present invention include nitrilotriacetic acid, ethylenediaminetetraacetic acid, triethylenetetraminehexaacetic acid and diethylenetetraminepentaacetic acid.

The developing solutions of the present invention may contain compounds, such as silver stain inhibitors described in JP-A-56-24347, uneven development inhibitors described in JP-A-62-212651 and dissolution aids described in Japanese Patent Application No. 60-109743.

The developing solutions of the present invention may contain, as buffering agents, boric acids described in Japanese Patent Application No. 61-28708 and saccharides (e.g., saccharose), oximes (e.g., acetoxime), phenols (e.g., 5-sulfosalicyclic acid) and tertiary phosphates (e.g., sodium salt, potassium salt) described in JP-A-60-93433.

Various compounds can be used as the development accelerators in the present invention. These compounds may be added to either the photographic materials or the processing solutions. Preferred examples of the development accelerators include amine compounds, imidazole compounds, imidazoline compounds, phosphonium compounds, sulfonium compounds, hydrazine compounds, thioether compounds, thione compounds, certain mercapto compounds, meso-ionic compounds and thiocyanates.

As discussed above, it is necessary that short-time rapid development can be carried out. To achieve rapid development, it to add the development accelerators to the color developing solutions. However, the development accelerators may be added to the photographic materials depending on the types of the accelerators or the arrangement of the sensitive layers on the support, as long as the sensitive layers can be rapidly processed. Alternatively, the development accelerators may be added to both the developing solutions and the photographic materials. If desired, a pre-bath for the color developing bath can be provided and the accelerators may be added to this pre-bath.

Useful amine compounds include both inorganic amines (e.g., hydroxylamine) and organic amines. Examples of the organic amines include aliphatic amines, aromatic amines, cyclic amines, aliphatic-aromatic mixed amines and heterocyclic amines. All of primary, secondary and tertiary amines and quaternary ammonium compounds are effective.

After color development, the photographic emulsion layers are generally bleached. Bleaching may be carried out simultaneously with or separately from fixing. After bleaching, a bleach-fixing treatment may be conducted to expedite processing. Examples of bleaching agents include compounds of polyvalent metals such as iron(III), cobalt(III), chromium(VI) and copper(II), peracids, quinones and nitro compounds. Typical examples of the bleaching agents include ferricyanides; dichromates; organic complex salts of iron(III) and cobalt(III) such as complex salts of polyaminocarboxylic acids (e.g ., ethylenediaminetetraacetic acid, diethylenetriaminepentaacetic acid, nitrilotriacetic acid, 1,3-diaminopropanetetraacetic acid), citric acid, tartaric acid, malic acid, etc.; persulfates; permanganates; and nitrosophenol. Among them, (ethylenediaminetetraacetonato)iron(III) complex, (diethylenetriaminepentaacetonato)iron(III) complex and persulfates are preferred in regard to rapid processing and the prevention of environmental pollution. Further, (ethylenediaminetetraacetonato)iron(III) complex is particularly useful for an independent bleaching solution as well as an onebath bleach-fixing solution.

If desired, the bleaching solution, the bleach-fixing solution and the previous bath thereof may contain bleaching accelerators. Examples of the bleaching accelerators include compounds having a mercapto group or a disulfide group described in U.S. Pat. No. 3,893,858, West German Patents 1,290,812 and 2,059,988, JP-A-53-32736, JP-A-53-57831, JP-A-53-37418, JP-A-53-65732, JP-A-53-72623, JP-A-53-95630, JP-A-53-95631, JP-A-53-104232, JP-A-53-124424, JP-A-53-141623, JP-A-53-28426 and *Research Disclosure* No. 17129 (July 1978); thiazolidine derivatives described in JP-A-50-140129; thiourea derivatives described in JP-B-45-8506, JP-A-52-20832, JP-A-53-32735 and U.S. Pat. No. 3,706,561; iodides described in West German Patent 1,127,715 and JP-A-58-16235; polyoxyethylene compounds described in West German Patents 996,410 and 2,748,430; polyamine compounds described in JP-B-45-8836; compounds described in JP-A-49-42434, JP-A-49-59644, JP-A-53-94927, JP-A-54-35727, JP-A-55-26506 and JP-A-58-163940; and bromide and iodide ions. Among them, the compounds having a mercapto group or a disulfide group are preferred in regard to a high accelerating effect. Particularly, the compounds described in U.S. Pat. No. 3,893,858, West German Patent 1,290,812 and JP-A-53-95630 are preferred. Further, the compounds described in U.S. Pat. No. 4,552,834 are preferred. These bleaching accelerators may be incorporated in the photographic materials. These bleaching accelerators are particularly effective in the bleach-fixing of the color photographic materials for photography.

Examples of fixing agents include thiosulfates, thiocyanates, thioether compounds, thioureas and various iodides. The thiosulfates are widely used as the fixing agents. Sulfites, bisulfites and carbonyl bisulfite adducts are preferred as preservatives for the bleach-fixing solutions.

Usually, a rinsing treatment and/or a stabilization treatment are/is carried out after the bleach-fixing treatment or fixing treatment. Various known compounds may be added to the rinsing stage and the stabilization stage to prevent precipitation or to save water. To prevent precipitation, various compounds can be added, including water softeners such as inorganic phosphoric acid, aminopolycarboxylic acids, organic aminopolyphosphonic acids and organic phosphoric acid; germicide or antifungal agents can be added for preventing the growth of bacteria, algae or mold; and metal salts such as magnesium salt, aluminum salt and bismuth salt can be added. Further, surfactants may be added to prevent unevenness in the drying load. Moreover, hardening agents may be added. If desired, compounds described in L. W. West, *Phot. Sci. Eng.*, Vol. 6, pages 344–359 (1965) may be added. Particularly, the addition of chelating agents and antifungal agents is effective.

Generally, the rinsing stage is a countercurrent system comprising two or more tanks to save water. If desired, a multi-stage countercurrent stabilization treatment stage as described in JP-A-57-8543 may be carried out in place of the rinsing stage. In this stage, a countercurrent bath comprising 2 to 9 tanks is required. Various compounds in addition to the above-described additives are added to the stabilization bath to stabilize image. For example, various buffering agents (e.g., borates, metaborates, borax, phosphates, carbonates, potassium hydroxide, sodium hydroxide, ammonia water, monocarboxylic acids, dicarboxylic acids, polycarboxylic acids or combinations thereof) for adjusting the pH of a layer (e.g., pH of 3 to 9) and aldehydes such as formaldehyde (in the form of a 40% aqueous solution) are added. If desired, additives such as chelating agents (e.g., inorganic phosphoric acids, aminopolycarboxylic acids, organic phosphoric acids, organic phosphonic acids, aminopolyphosphonic acids, phosphonocarboxylic acids), germicide (e.g., benzisothiazolinone, isothiazolone, 4-thiazolinebenzimidazole, halogenated phenol, sulfanilamide, benztriazole), surfactants, fluorescent brighteners and hardening agents may be used. These additives may be used either alone or in combination of two or more for the same or different purposes.

Preferably, an ammonium salt such as ammonium chloride, ammonium nitrate, ammonium sulfate, ammonium phosphate, ammonium sulfite or ammonium thiosulfate is added to adjust the pH of the layers after processing.

In the case of the color photographic materials for photography, rinsing-stabilization stage conventionally carried out after fixing can be replaced with the above-mentioned stabilization stage and rinsing stage (water saving treatment). In this case, formaldehyde (in the form of a 40% aqueous solution) in the stabilization bath may be removed when two equivalent type magenta couplers are used.

The color developing agents may be incorporated in the silver halide color photographic materials of the present invention for the purpose of simplifying and expediting processing. Preferably, color developing agent precursors are incorporated in the photographic materials. Examples of the precursors include indoaniline compounds described in U.S. Pat. No. 3,342,597; Schiff base type compounds described in U.S. Pat. No. 3,342,599, *Research Disclosure* No. 14850 and *Research Disclosure ibid.* No. 15159; aldol compounds described in *Research Disclosure* No. 13924; metal complex salts described in U.S. Pat. No. 3,719,492; urethane compounds described in JP-A-53-135628; and various precursors described in JP-A-56-6235, JP-A-56-16133, JP-A-56-59232, JP-A-56-67842, JP-A-56-83734, JP-A-56-83735, JP-A-56-83736, JP-A-56-89735, JP-A-56-81837, JP-A-56-54430, JP-A-56-106241, JP-A-56-107236, JP-A-57-97531 and JP-A-57-83565.

If desired, 1-phenyl-3-pyrazolidone compounds may be incorporated in the silver halide color photographic materials of the present invention to accelerate color development.

Typical examples of the compounds are described in JP-A-56-64339, JP-A-57-144547, JP-A-57-211147, JP-A-58-50532, JP-A-58-50536, JP-A-58-50533, JP-A-58-50534, JP-A-58-50535 and JP-A-58-115438.

In the present invention, various processing solutions are used at a temperature of 10° to 50° C. Generally, a temperature of 33° to 38° C. is used. However, it is possible to use a higher temperature to accelerate processing and shorten processing time, while a lower temperature can be used to improve image quality and to improve the stability of the processing solutions. If desired, a treatment using cobalt intensification or hydrogen peroxide intensification described in West German Patent 2,226,770 and U.S. Pat. No. 3,674,499 may be carried out to save silver.

If desired, heaters, temperature sensors, liquid level sensors, circulating pumps, filters, floating lids and squeegees may be provided with the processing baths.

When continuous processing is carried out, it is preferable to use the replenisher of each processing solution to prevent the composition of the processing solution from varying and to obtain a uniform finish. The rate of replenishment can be reduced to half or less of the standard replenishment rate to reduce cost.

Generally, bleach-fixing treatment is carried out when the sensitive material of the present invention is color paper. If desired, the bleach-fixing treatment may be conducted even when the material of the present invention is a color photographic material for photography.

The processing time of the present invention refers to the amount of time which elapses from the time when the top of the photographic material enters the developing solution until the time when the top of the photographic material leaves the final drying zone in an automatic processor. The processing time is generally not longer than 150 seconds, preferably not longer than 60 seconds, more preferaly not longer than 45 seconds, and preferably not less than 5 seconds.

The present invention is now illustrated in greater detail by reference to the following examples which, however, are not to be construed as limiting the invention in any way. Unless otherwise indicated, all parts, percents and ratios are by weight.

EXAMPLE 1-a

A biaxially oriented polyethylene terephthalate film (dyed blue) of 175 μm in thickness was subjected to corona discharge treatment and then coated with the following first undercoating solution by means of a wire bar coater in such an amount as to give the following coating weights. The coated film was dried at 175° C. for one minute. The other side thereof was coated in the same way to form a first undercoat layer on that side.

| First Undercoat Layer | |
|---|---|
| Butadiene-styrene copolymer latex (solid: 40% butadiene/styrene ratio = 31/69 by weight) | 0.16 g/m$^2$ |
| Sodium salt of 2,4-dichloro-6-hydroxy-s-triazine | 3.2 mg/m$^2$ |

Preparation of Support 1-a

The surface of the first undercoat layer was coated with the following second undercoat layer in such an amount as to give the following coating weights. The coated product was dried at 150° C. for one minute. In this way, the second undercoat layer was formed on both sides of the coated film.

| | |
|---|---|
| Gelatin | 0.16 g/m$^2$ |
| $C_{12}H_{25}O(CH_2CH_2O)_{10}H$ | 7.5 mg/m$^2$ |

Preparation of Supports 1-b to 1-e

The surface of the first undercoat layer was coated with the following second undercoat layer in such an amount as to give the following coating weights. The coated product was dried at 150° C. for one minute. In this way, the second undercoat layer was formed on both sides of the coated film.

| | |
|---|---|
| Gelatin | amount given in Table 1 |
| Dye | compound and amount given in Table 1 |
| $C_{12}H_{25}O(CH_2CH_2O)_{10}H$ | 7.5 mg/m$^2$ |

Preparation of Dye (I-29) Solution

Dye (I-29) was previously dissolved in an alkaline solution having a pH of 10. Gelatin was added thereto. The pH of the mixture was adjusted to 5 by HCl.

Thereafter, particles having a size of not smaller than 1 μm were substantially removed by centrifugation at 5000 rpm for 1 minute.

Preparation of Dye (I-30) Solution

Water (434 ml) and a 6.7% solution of Triton X-200 surfactant (53 g) (TX-200, a product of Rohm & Hass Co.) were put into a 1.5 l screw cap bottle. 20 g of Dye (I-30) and 800 ml of zirconium oxide (ZrO) beads (2 mm diameter) were added thereto. The bottle was firmly capped and placed in a mill. The contents were crushed for 4 days.

The contents were added to 160 g of a 12.5% aqueous solution of gelatin. The mixture was placed in a roll mill to reduce foam. The resulting mixture was filtered to remove the ZrO beads.

Thereafter, particles having a size of not smaller than 1 μm were substantially removed by centrifugation at 5000 rpm for 1 minute.

Preparation of Support 1-f

The surface of the first undercoat layer was coated with the following second undercoat layer in such an amount as to give the following coating weights. The coated product was dried at 150° C. for one minute. In this way, the second undercoat layer was formed on both sides of the coated film.

| | |
|---|---|
| Gelatin | 0.16 g/m$^2$ |
| Comparative Dye 1 | 15 mg/m$^2$ |

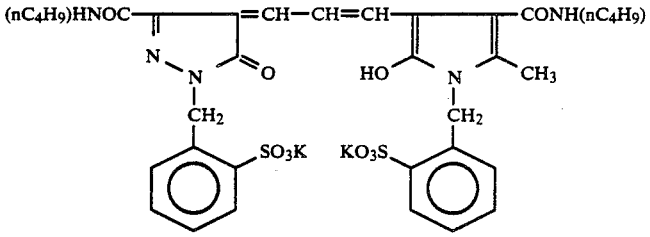

| | |
|---|---|
| Compound A (Mordant agent) | 35 mg/m$^2$ |

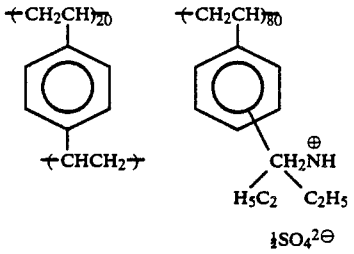

| | |
|---|---|
| $C_{12}H_{25}O(CH_2CH_2O)_{10}H$ | 7.5 mg/m$^2$ |

(1) Preparation of Emulsion (1)

5 g of potassium bromide, 0.05 g of potassium iodide, 25.5 g of gelatin and 2.5 cc of a 5% aqueous solution of the thioether $HO(CH_2)_2S(CH_2)_2OH$ were added to 1 l of water. The resulting solution was kept at 69° C. while being stirred. An aqueous solution of 8.35 g of silver sulfate and an aqueous solution containing 5.94 g of potassium bromide and 0.726 g of potassium iodide were added to the solution kept at 69° C. with stirring over a period of 45 seconds by means of the double jet process. Subsequently, 2.9 g of potassium bromide was added thereto. Further, an aqueous solution containing 8.35 g of silver nitrate was added thereto over a period of 26 minutes at such a rate that the flow rate at the time of completion of the addition was twice that at the time of commencement of the addition. Thereafter, 20 cc of a 25% ammonia solution and 10 cc of 50% $NH_4NO_3$ were added thereto and physical ripening was carried out for 20 minutes. Neutralization was then carried out by adding 240 cc of 1N sulfuric acid. Subsequently, an aqueous solution of 149.9 g of silver nitrate and an aqueous solution of potassium bromide were added thereto over a period of 40 minutes by means of the controlled double jet process while the potential was kept at a pAg of 8.2. The addition was carried out at such an accelerating rate that the flow rate at the time of completion of the addition was 9 times that at the time of commencement of the addition. After the completion of the addition, 15 cc of 2N potassium thiocyanate was added thereto. Further, 25 cc of a 1% aqueous solution of potassium iodide was added thereto over a period of 30 seconds. The temperature of the mixture was lowered to 35° C. and soluble salts were removed by the precipitation .method. The temperature was raised to 40° C. Then, 74.5 g of gelatin and 1.2 g of Proxel were added thereto. The pH was adjusted to 6.40, and the pAg was adjusted to 8.10 by using sodium hydroxide and potassium bromide.

After the temperature was raised to 56° C., 600 mg of the following sensitizing dye and 150 mg of the following stabilizer were added thereto. After 10 minutes, 2.4 mg of sodium thiosulfate pentahydrate, 140 mg of potassium thiocyanate and 2.1 mg of chloroauric acid were added to each emulsion. After 80 minutes, the mixture was solidified by quenching to obtain an emulsion. The resulting emulsion was composed of grains having such a grain size distribution that grains having an aspect ratio of not lower than 3 accounted for 95% of the sum total of the projected areas of the entire grains. With regard to all grains having an aspect ratio of not lower than 2, the average diameter of the projected area was 1.4 μm, the standard deviation was 15%, the average thickness was 0.190 μm and the aspect ratio was 7.4.

Sensitizing dye

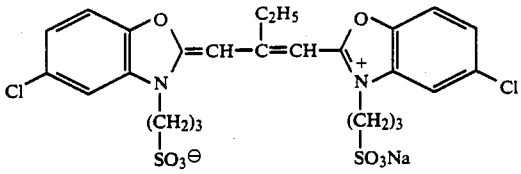

Stabilizer

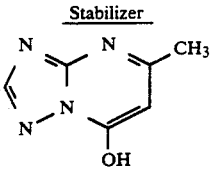

(2) Preparation of Emulsion Coating Solution

The following reagents were added per mol of silver halide to the emulsion to prepare a coating solution.

| | |
|---|---|
| Polymer latex (Poly(ethyl acrylate/methacrylic acid) = 97/3) | 25.0 g |
| Hardening agent (1,2-bis(sulfonyl-acetamido)ethane) | 8 mmol per 100 g of gelatin in surface protective layer and emulsion layer |
| 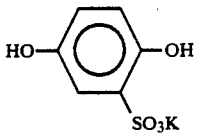 | 12.0 g |
| 2,6-Bis(hydroxyamino)-4-diethylamino-1,3-triazine | 80 mg |
| Polysodium acrylate (average molecular weight: 41,000) | 4.0 g |
| Polypotassium styrenesulfonate (average molecular weight: 600,000) | 1.0 g |

(3) Preparation of Coating Solution for Surface Protective Layer

The coating solution for the surface protective layer was prepared by using each component in such an amount as to give the following coating weight.

| | Coating Weight (g/m²) |
|---|---|
| Surface Protective Layer | |
| Gelatin | given in Table 1-a |
| Polyacrylamide (average molecular weight: 45,000) | 0.25 |
| Polysodium acrylate (average molecular weight: 400,000) | 0.02 |
| Sodium salt of sulfonated p-t-octylphenoxydiglycerylbutyl | 0.02 |
| Poly(degree of polymerization: 10) oxyethylene acetyl ether | 0.035 |
| Poly(degree of polymerization: 10) oxyethylene-poly (degree of polymerization: 3) oxyglyceryl p-octylphenoxy ether | 0.01 |

-continued

| | Coating Weight (g/m²) |
|---|---|
| $C_8F_{17}SO_3K$ | 0.003 |
| $C_8F_{17}SO_2N(C_3H_7)(CH_2)_4(CH_2)_4SO_3Na$ | 0.001 |
| $C_8F_{17}SO_2N(C_3H_7)(CH_2CH_2O)_{10}(CH_2CHCH_2O)_4H$ | 0.003 |
| Polymethyl methacrylate (average particle size: 3.5 μm) | 0.025 |
| Poly(methyl methacrylate/methacrylate) (molar ratio = 7:3, average particle size: 2.5 μm) | 0.020 |
| Antihalation (AH) Layer | |
| Gelatin | 0.16 g/m² |
| Dye I-29 | 19 mg/m² |
| 1,2-Bis(sulfonylacetamido) ethane | 0.013 mmol/m² |

The dye was dispersed in the coating solution for the AH layer in the same manner as in preparation of Dye (I-30) Solution of Example 1-a.

Preparation of Photographic Material 1-1

The surface of the support was coated with the AH layer, the emulsion layer and the surface protective layer in this order according to Table 1-a, and dried to obtain the photographic material 1-1.

Preparation of Photographic Material 1-2 to 1-12

Each of the supports 1-2 to 1-12 was coated with the emulsion layer and the protective layer in this order, and dried to obtain each of photographic materials 1-2 to 1-12.

Evaluation of Photographic Performance

Grenex orthoscreen HR-4 (a product of Fuji Photo Film Co., Ltd.) was brought into close contact with both sides of the photographic material by using a cassette. X-ray sensitometry was carried out. The exposure amount was controlled by varying the distance between the X-ray tube and the cassette. After exposure, the photographic material was processed (1) in an automatic processor under the following conditions by using the following developing solution and fixing solution.

| | |
|---|---|
| Development | 35° C. × 9.5 sec |
| Fixing | 31° C. × 10 sec |
| Rinse | 15° C. × 6 sec |
| Squeeze | 6 sec |
| Drying | 50° C. × 12 sec |
| Dry to Dry Processing Time | 45 sec |

When an undried sample was obtained, the sample was air-dried after processing.

The developing solution and the fixing solution had the following compositions.

| Developing Solution | |
|---|---|
| Potassium hydroxide | 29 g |
| Potassium sulfite | 44.2 g |
| Sodium hydrogencarbonate | 7.5 g |
| Boric acid | 1.0 g |
| Diethylene glycol | 12 g |
| Ethylenediaminetetraacetic acid | 1.7 g |

-continued

| | |
|---|---|
| 5-Methylbenztriazole | 0.06 g |
| Hydroquinone | 25 g |
| Glacial acetic acid | 18 g |
| Triethylene glycol | 12 g |
| 5-Nitroindazole | 0.25 g |
| 1-Phenyl-3-pyrazolidone | 2.8 g |
| Glutaraldehyde (50 wt/wt %) | 9.86 g |
| Sodium metabisulfite | 12.6 g |
| Potassium bromide | 3.7 g |
| Water added to make | 1 l |
| Fixing Solution | |
| Ammonium thiosulfate (70 wt/vol %) | 200 ml |
| Disodium ethylenediaminetetra-acetate dihydrate | 0.02 g |
| Sodium sulfite | 15 g |
| Boric acid | 10 g |
| Sodium hydroxide | 6.7 g |
| Glacial acetic acid | 15 g |
| Aluminum sulfate | 10 g |
| Sulfuric acid (36N) | 3.9 g |
| Water added to make | 1 l |
| pH | adjusted to 4.25 |

Measurement of Sharpness (MTF)

MTF is described in T. H. James, *The Theory of the Photographic Process*, pages 592–618 (1977, Macmillan). MTF was measured by using the combination of the above-described HR-4 screen with the above-described processing by the automatic processor. The measurement was made with an aperture of 30 μm×500 μm. An evaluation was made at an optical density of 1.0 with a MTF value of a spatial frequency of 1.0 cycle/mm.

Evaluation of Dryness

Film having a size of 24.5×30.5 cm was processed in the above-described automatic processor. Film discharged from the drying zone was immediately touched with the hand, and dryness was inspected.

The results are shown in Table 1-a based on a rating according to the following classification.

○: Sufficiently dried.

x: Film discharged was damp and insufficiently dried.

xx: Film discharged was wetted and stuck to other film.

Evaluation of Scratch

Unexposed photographic materials 1-1 to 1-12 were air-conditioned at 25° C. and 25% RH for 2 hours. A constant load of 40 g/cm$^2$ was applied to an area of 1 cm×2.5 cm, and photographic materials 1-1 to 1-12 were rubbed with a commercially available nylon scrub brush at a speed of 1 cm/sec in a linear direction. Thereafter, development, fixing and rinsing were carried out in the same way as in the above-described processing to evaluate the photographic performance. After processing, the number of scratches on the photographic materials 1-1 to 1-12 was determined, the scratches being formed by nylon scrub brush. The results are shown in Table 1-a.

Evaluation of After-color

Photographic materials 1-1 to 1-12 were processed in the same way as in the processing for the evaluation of photographic performance except that the photographic materials were not exposed. After-color after processing was organoleoptically evaluated. The results are shown in Table 1-a based on a rating according to the following classification.

◎: After-color is unnoticeable.

○: After color is slightly formed, but it is no problem in practical use.

x: After-color is noticeable and is a problem in practical use.

TABLE 1-a

| Photographic Material | Dye | Amount of Dye (mg/m$^2$) | Amount of Gelatin of Colored layer (g/m$^2$) | AH layer* | Support | Amount of Gelatin of PC* (g/m$^2$) | Total Amount of Gelatin (g/m$^2$) | MTF | Dryness | The number of Scratches (number) | After-Color |
|---|---|---|---|---|---|---|---|---|---|---|---|
| 1-1 (Comp. Ex.) | — | 0 | 0.16 | omitted | 1-a | 1.1 | 2.9 | 0.51 | ○ | 34 | ◎ |
| 1-2 (Comp. Ex.) | Comparative Dye 1 | 15 | 0.16 | " | 1-f | 1.1 | 2.9 | 0.71 | ○ | 34 | X |
| 1-3 (Comp. Ex.) | I-29 | 19 | 0.6 | " | 1-b | 0.7 | 2.9 | 0.71 | ○ | 63 | ○ |
| 1-4 (Comp. Ex.) | I-29 | 19 | 0.6 | " | 1-b | 1.1 | 3.3 | 0.71 | XX | 35 | ○ |
| 1-5 (Comp. Ex.) | I-29 | 19 | 0.16 | " | 1-c | 1.5 | 3.3 | 0.70 | XX | 20 | ○ |
| 1-6 (Comp. Ex.) | — | — | 0.16 | provided | 1-a | 0.9 | 2.9 | 0.71 | ○ | 51 | ◎ |
| 1-7 (Comp. Ex.) | — | — | 0.16 | " | 1-a | 1.1 | 3.1 | 0.72 | X | 36 | ◎ |
| 1-8 (Comp. Ex.) | I-30 | 14 | 0.6 | omitted | 1-d | 0.7 | 2.9 | 0.72 | ○ | 63 | ○ |
| 1-9 (Comp. Ex.) | I-30 | 14 | 0.6 | " | 1-d | 1.1 | 3.3 | 0.71 | XX | 35 | ○ |
| 1-10 (Comp. Ex.) | I-30 | 14 | 0.16 | " | 1-e | 1.5 | 3.3 | 0.70 | XX | 20 | ○ |
| 1-11 (Invention) | I-29 | 19 | 0.16 | " | 1-c | 1.1 | 2.9 | 0.72 | ○ | 34 | ○ |
| 1-12 (Invention) | I-30 | 14 | 0.16 | " | 1-e | 1.1 | 2.9 | 0.72 | ○ | 35 | ○ |

note)
AH Layer*: Dye, I-29; Amount of Dye, 19 mg/m$^2$; Amount of Gelatin of AH layer 0.16 g/m$^2$
Amount of Geratin of PC*: Amount of Geratin of Surface Protective layer It is apparent from Table 1-a that photographic materials excellent in sharpness, dryness and pressure resistance can be obtained by present invention.

EXAMPLE 1-b

Photographic materials 1-1, 1-2, 1-7, 1-11, and 1-12 were processed in an automatic processor under the following conditions. After-color and dryness were evaluated in the same manner as in Example 1-a. The results are shown in Table 1-b based on the classifications used in Example 1-a.

| | |
|---|---|
| Development | 35° C. × 6.3 sec |
| Fixing | 31° C. × 6.7 sec |
| Rinse | 15° C. × 4 sec |
| Squeeze | 4 sec |
| Drying | 60° C. × 8 sec |
| Dry to Dry Processing Time | 29 sec |

The developing solution and the fixing solution were prepared in the same manner as in Example 1-a.

TABLE 1-b

| Photographic Material | Dryness | After-Color |
|---|---|---|
| 1-1 (Comp. Ex.) | ○ | ○ |
| 1-2 (Comp. Ex.) | ○ | X |
| 1-7 (Comp. Ex.) | XX | ○ |
| 1-11 (Invention) | ○ | ○ |
| 1-12 (Invention) | ○ | ○ |

It is apparent from Table 1-b that photographic materials having satisfactory performance with regard to dryness and after-color can be obtained even in ultrarapid processing wherein the development time is not longer than 30 seconds.

EXAMPLE 2

A biaxially oriented polyethylene terephthalate film of 100 μm in thickness was subjected to corona discharge treatment and coated with the following first undercoat layer by means of a wire bar coater in such an amount as to give the following coating weights. The coated support was dried at 170° C. for one minute.

| First Undercoat Layer | |
|---|---|
| Butadiene-styrene copolymer latex (butadiene/styrene ratio = 31/69 by weight) | 0.16 g/m$^2$ |
| Sodium salt of 2,4-dichloro-6-hydroxy-s-triazine | 4.2 g/m$^2$ |

Preparation of Support 2-a

The surface of the first undercoat layer was coated with the following second undercoat layer in such an amount as to give the following coating weights. The coated product was dried at 150° C. for one minute to form the second undercoat layer.

| | |
|---|---|
| Gelatin | 0.16 g/m$^2$ |
| $C_{12}H_{25}O(CH_2CH_2O)_{10}H$ | 7.5 g/m$^2$ |

Preparation of Supports 2-b

The surface of the first undercoat layer was coated with the following second undercoat layer in such an amount as to give the following coating weights. The coated product was dried at 150° C. for one minute to form the second undercoat layer.

| | |
|---|---|
| Gelatin | 0.4 g/m$^2$ |
| Dye | Compound and amount given in Table 2 |
| Dye | 80 mg/m$^2$ |

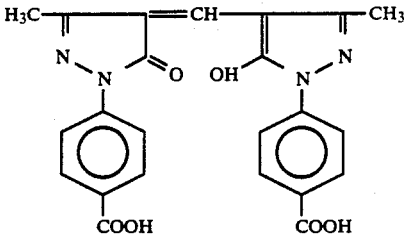

| | |
|---|---|
| $C_{12}H_{25}O(CH_2CH_2O)_{10}H$ | 7.5 mg/m$^2$ |

Preparation of Dye Solution

The dye solution was prepared in the same way as in the preparation of the Dye (I-30) solution of Example 1.

Preparation of Emulsion (2)

| | |
|---|---|
| Solution 2-I 75° C. | |
| Inert gelatin | 24 g |
| Distilled water | 900 ml |
| KBr | 4 g |
| 10% Aqueous solution of phosphoric acid | 2 ml |
| Sodium salt of benzenesulfinic acid | 5 × 10$^{-2}$ mol |
| 1,2-Bis(2-hydroxyethylthio)ethane | 2.5 × 10$^{-3}$ g |
| Solution 2-II 35° C. | |
| Silver nitrate | 170 g |
| Distilled water to make | 1000 ml |
| Solution 2-III 35° C. | |
| KBr | 230 g |
| Add water | 1000 ml |
| Solution 2-IV room temperature | |
| Potassium hexacyanoferrate (II) | 3.0 g |
| Distilled water to make | 100 ml |

Solutions 2-II and 2-III were simultaneously added to Solution 2-I over a period of 5 minutes. The addition of Solutions 2-II and 2-III was temporarily stopped when octagonal grains having a mean grain size of 0.10 μm were formed. 115 mg of sodium thiosulfate and 115 mg of chloroauric acid tetrahydrate were added thereto, each amount being per mol of silver. Chemical sensitization was carried out at 75° C. for 60 minutes. The simultaneous addition of Solutions 2-II and 2-III to the thus-obtained chemically sensitized core grains was resumed. After 5 minutes from the commencement of the addition of Solution 2-II, Solution 2-IV was added thereto over a period of 5 minutes. The remainder of Solution 2-II was added thereto at 75° C. over a period of 40 minutes while the addition rate of Solution 2-III was controlled so that the pAg value of the mixture was 7.50. In this way, a cubic core/shell type emulsion having a mean grain size of 0.28 μm was finally obtained. After rinsing, desalting was carried out by the precipitation method, and the emulsion was dispersed in an aqueous solution containing 90 g of inert gelatin. 34 mg of sodium thiosulfate and 34 mg of chloroauric acid tetrahydrate were added to the emulsion, each amount being per mol of silver. After the pH value and pAg value were adjusted to 8.9 and 7.0 (at 40° C.), respectively, chemical sensitization was carried out at 75° C. for 60 minutes.

The dye was dispersed in coating solution for the AH layer in the same manner as in preparation of Dye (I-30)

| Antihalation (AH Layer) | |
|---|---|
| Gelatin | 1.7 g/m$^2$ |
| Compound | 67.8 mg/m$^2$ |

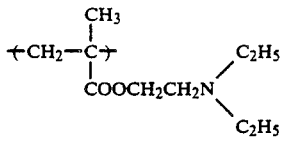

| | |
|---|---|
| Dye | 22.4 mg/m$^2$ |

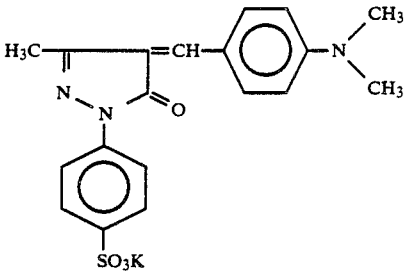

| | |
|---|---|
| Dye | 28.5 mg/m$^2$ |

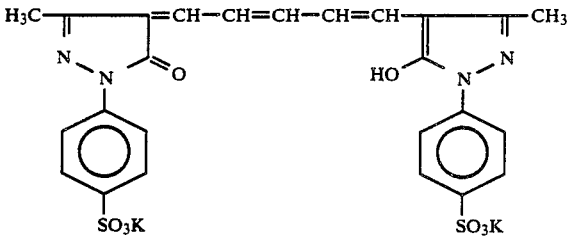

| | |
|---|---|
| Dye | 48.5 mg/m$^2$ |

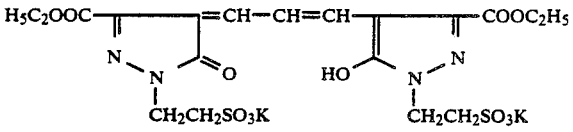

| | |
|---|---|
| 1,2-Bis(vinylsulfonyl)-2-propanol | 53.7 mg/m$^2$ |
| Phenoxyethanol | 1.9 mg/m$^2$ |

Solution of Example 1-a.

| Emulsion Layer | |
|---|---|
| Silver halide emulsion (in terms of silver) | 1700 mg/m$^2$ |
| Sensitizing dye (Compound (a)) | 23.8 mg/m$^2$ |
| Nucleating agent (Compound (b)) | 0.0394 mg/m$^2$ |
| 5-Methylbenztriazole | 4.1 mg/m$^2$ |
| Sodium dodecylbenzenesulfonate | 5 mg/m$^2$ |
| 1,3-Divinylsulfonyl-2-propanol | 56 mg/m$^2$ |
| Polysodium styrenesulfonate | 35 mg/m$^2$ |

Sensitizing dye (Compound (a))

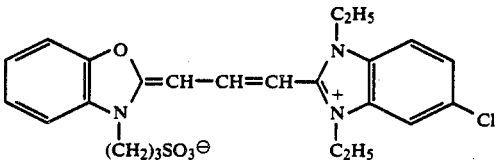

Nucleating agent (Compound (b))

-continued

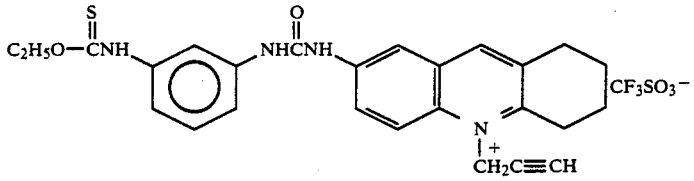

| Surface Protective Layer | |
|---|---|
| Inert gelatin | 1100 mg/m$^2$ |
| Colloidal silica | 249 mg/m$^2$ |
| Liquid paraffin | 60 mg/m$^2$ |
| Strontium barium sulfate (average particle size: 1.5 μm) | 32 mg/m$^2$ |
| Proxel | 4.3 mg/m$^2$ |
| Potassium salt of perfluorooctane-sulfonyl-N-propylglycine | 5.0 mg/m$^2$ |
| 1,3-Bis(vinylsulfonyl)-2-propanol | 56 mg/m$^2$ |
| 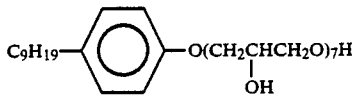 | 15 mg/m$^2$ |

Preparation of Photographic Material 2-1

The support 2-a was coated with the AH layer, the emulsion layer and the protective layer in this order, and dried to obtain the photographic material 2-1.

Preparation of Photographic Material 2-2

The supports 2-b was coated with the emulsion layer and the protective layer in this order and dried to obtain the photographic material 2-2.

Evaluation of Photographic Performance

Imagewise exposure was carried out through continuously density-changing wedge from the emulsion-coated side under a safety lamp for $10^{-3}$ seconds by using MARK-II xenon flash sensitometer manufactured by E.G. & G., U.S.A.

Processing (2) was carried out in an automatic processor under the following conditions by using general-purpose processing solution (FR-537 developing solution and FR-535 fixing solution manufactured by FR Chemicals, U.S.A.) for microfilm. Sensitivity was represented by the ratio of the reciprocal of the exposure amount giving a density of 1.0+fog. The sensitivity of the photographic material 2-1 was referred to as 100.

The results are shown in Table 2.

| Stage | Processing Solution | Temp. | Time |
|---|---|---|---|
| 1. Development | FR-537 (1:3) | 44° C. | 12 sec |
| 2. Rinse | Running water | 44° C. | 12 sec |
| 3. Fixing | FR-535 (1:3) | 44° C. | 12 sec |
| 4. Rinse | Spray water | 44° C. | 12 sec |
| 5. Drying | Hot air | 50° C. | 12 sec |

Evaluation of Sharpness

Sharpness was evaluated by MTF. The photographic materials were exposed to white light through a MTF measuring wedge for 1/100 seconds, and subjected to the above-described processing (2) in the automatic processor.

Measurement was made with an aperture of 400×2 μm$^2$. An evaluation was made at an optical density of 1.0 with a MTF value of a spatial frequency of 20 cycle/mm.

The results are shown in Table 2.

Evaluation of Dryness

The above-described processing (2) was carried out in the automatic processor. An evaluation was made in the same manner as in Example 1-a.

The results are shown in Table 2 based on the dryness classification used in Example 1-a.

TABLE 2

| Photographic Material | Dye in Undercoat Layer | Amount of Dye (mg/m$^2$) | AH Layer | Support | Total Amount of Gelation (g/m$^2$) | Sensitivity | MTF | Dryness |
|---|---|---|---|---|---|---|---|---|
| 2-1 (Comp. Ex.) | — | 0 | provided | 2-a | 4.57 | 100 | 1.0 | x |
| 2-2 (Invention) | I-1 | 80 | omitted | 2-b | 2.87 | 125 | 1.0 | ∘ |

It is apparent from Table 2 that photographic materials which can be rapidly processed and are excellent in sharpness, sensitivity and dryness can be obtained with the present invention.

EXAMPLE 3

Both sides of a biaxially oriented polyethylene terephthalate support of 100 μm in thickness were coated with a first undercoat layer having the following formulation (1) and a second undercoat layer having the following formulation (2) in order.

| Formulation (1) of First Undercoat Layer | |
|---|---|
| Aqueous dispersion of vinylidene chloride/methyl methacrylate/acrylonitrile/methacrylic acid | 15 parts by weight |

-continued

| Formulation (1) of First Undercoat Layer | |
|---|---|
| (90/8/1/1 ratio by weight) copolymer | |
| 2,4-Dichloro-6-hydroxy-s-triazine | 0.25 " |
| Fine particles of polystyrene (average particle size: 3μ) | 0.05 " |
| Compound (h) | 0.20 " |
| Add water to make | 100 " |

Further, 10 wt % KOH was added thereto to adjust the pH to 6. The resulting coating solution was coated in such an amount as to give a dry film of 0.9 μm in thickness when the coated wet film is dried at a drying temperature of 180° C. for 2 minutes.

Compound (h)

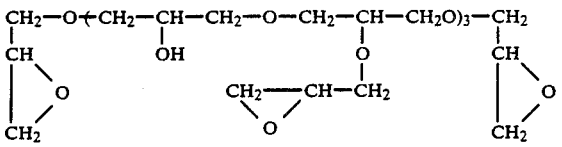

| Formulation (2) of Second Undercoat Layer | |
|---|---|
| Gelatin | 1 part by weight |
| Methyl cellulose | 0.05 part by weight |
| Compound (f) | 0.02 part by weight |
| $C_{12}H_{25}O(CH_2CH_2O)_{10}H$ | 0.03 part by weight |
| Compound (g) | $3.5 \times 10^{-3}$ part by weight |
| Acetic acid | 0.2 part by weight |
| Water to make | 100 part by weight |

The coating solution was coated in such an amount as to give a gelatin coating weight of 0.16 g/m² at a drying temperature of 170° C. for 2 minutes.

Compound (f)

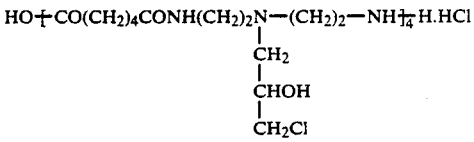

Compound (g)

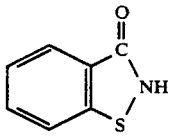

One side of the thus-obtained support was coated with an electrically conductive layer having the following formulation (3) and a back layer having the following formulation (4).

| Formulation (3) of Electrically Conductive Layer | |
|---|---|
| $SnO_2/Sb$ (9/1 ratio by weight, average particle diameter: 0.25 μm) | 300 mg/m² |
| Gelatin | 170 mg/m² |
| Compound (g) | 7 mg/m² |
| Sodium dodecylbenzenesulfonate | 10 mg/m² |
| Dihexyl sodium α-sulfosuccinate | 40 mg/m² |
| Polysodium styrenesulfonate | 9 mg/m² |
| **Formulation (4) of Back Layer** | |
| Gelatin | 2.9 g/m² |
| Compound (c) | 300 mg/m² |
| Compound (d) | 50 mg/m² |
| Compound (e) | 50 mg/m² |
| Compound (g) | 10 mg/m² |
| Sodium dodecylbenzenesulfonate | 70 mg/m² |
| Dibenzyl sodium α-sulfosuccinate | 15 mg/m² |
| 1,2-Bis(vinylsulfonylacetamido)ethane | 150 mg/m² |
| Ethyl acrylate latex (average particle diameter: 0.05μ) | 500 mg/m² |
| Lithium perfluorooctanesulfonate | 10 mg/m² |
| Fine powder of silicone dioxide (average particle size: 4μ, pore diameter: 170 Å, surface area: 300 m²/g) | 35 mg/m² |

Further, the other side of the thus-obtained support was coated with the following formulation.

Compound (c) 300 mg/m²

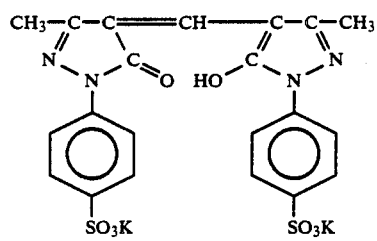

Compound (d) 50 mg/m²

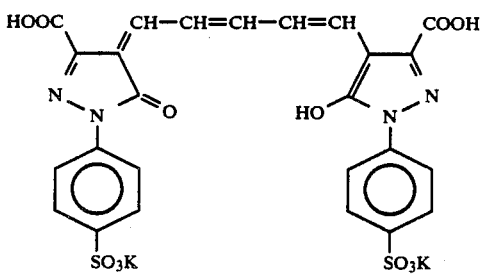

-continued

Compound (e) 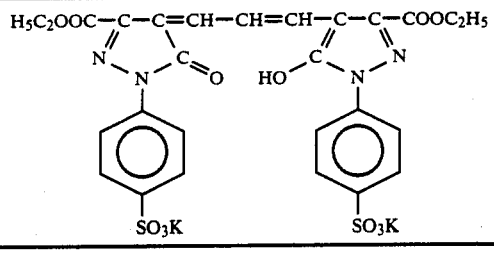 50 mg/m²

Emulsion A was prepared in the following manner by using the following Solutions A-I and A-II, A-IIIA.

(1) Emulsion A (Br: 1 mol %, grain size: 0.20 μ, Rh: $1.0\times10^{-5}$ mol/mol of Ag).

Solution A-I

Water: 600 ml, gelatin: 18 g, pH: 3.0.

Solution A-II $AgNO_3$: 200 g, water: 800 ml.

Solution A-IIIA

KBr: 1.4 g, NaCl: 76 g, $(NH_4)_3RhCl_6$: 4 mg, water: 800 ml.

Solutions A-II and A-IIIA were added at a constant rate to Solution A-I kept at 40° C. over a period of 20 minutes by the double jet process. After soluble salts were removed from the emulsion by conventional method, gelatin was added thereto. Further, 2-methyl-4-hydroxy-1,3,3a,7-tetraazaindene was added as a stabilizer thereto without carrying out chemical sensitization. The emulsion had a mean grain size of 0.20 μ and a gelatin content of 60 g. The yield of the emulsion was 1 Kg. The following hydrazine compound (Hz) was added to the emulsion in an amount of $4\times10^{-4}$ mol per mol/Ag.

Hydrazine compound (Hz)

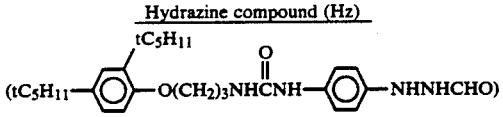

The following ultraviolet light absorber (UV

Ultraviolet light absorber (UV absorber)

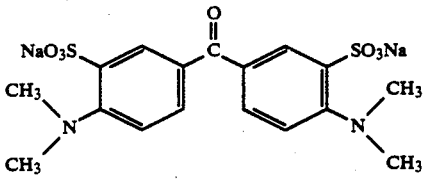

absorber) was added to the resulting emulsion in such an amount as to give 100 mg/m². 30 wt % (on a solid basis, based on the amount of gelatin) of polyethyl acrylate latex was added thereto. Further, 1,3-vinylsulfonyl-2-propanol as a hardening agent was added thereto. The polyethylene terephthalate film was then coated with the resulting emulsion in such an amount as to give 2.5 g of Ag/m² and 1.18 g of gelatin/m². A surface protective layer was coated on the resulting emulsion-coated layer to improve safe light safety, thus preparing Sample 3-1. The protective layer was coated in such an amount as to give 120 mg of the yellow dye/m² and 1.3 g of gelatin/m².

Yellow Dye

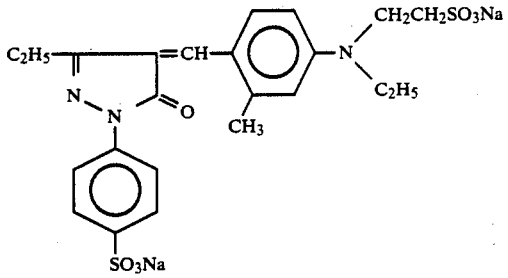

Further, the compounds (c), (d) and (e) were removed from the formulation (4) of the back layer, only the formulation (2) of the second undercoat layer on the emulsion layer side was changed to the formulation given in Table 3, dispersions of dyes prepared as in Examples 1 to 7 of WO 88/04794 were added and a coating was made so as to give a gelatin coating weight of 0.40 g per m² to prepare Samples 3-2 to 3-4.

TABLE 3

| Sample No. | Compound in Second Undercoat Layer on Emulsion Layer Side | Amount of Compound in Formulation (2) |
|---|---|---|
| 3-2 | — | — |
| 3-3 | III-1 | 0.5 part by weight |
| 3-4 | I-28 | 0.5 part by weight |

The original structure comprising (a) sample, (b) half tone original, (c) transparent or semitransparent laminated base, (d) line original and (e) transparent or semitransparent laminated base was prepared by using each of Samples 3-1 to 3-4. Exposure was carried out from the side of (e) with an ultra-high pressure mercury lamp ORc-CHM-1000 (P-607, manufactured by Dainippon Screen K.K.). The exposure amount was controlled through a neutral density filter (ND filter) so that each sample was exposed for the same period of time. Processing was carried out at 38° C. for 12 seconds (dry to dry: about 50 seconds) by using the following Developing Solution A and automatic processor FG-310PTS (manufactured by Fuji Photo Film Co., Ltd.). The fixing solution used was GR-Fl. The offprinted letter image quality of was evaluated.

The term "image quality 5 of offprinted letter" as used herein refers to such an image quality that 30 μm wide letters are reproduced when an original is used and normal exposure was used so that a 50% halftone-area gives a 50% halftone area on a photographic material for dot to dot work. A very good image quality of offprinted letter results. On the other hand, the term "image quality 1 of offprinted letter" as used herein refers to such an image quality that only letters having a width of 150 μm or larger are reproduced when normal exposure is used. It is a very bad image quality of offprinted letter. The ranking of from 4 to 2 between the ranks of 5 and 1 is made by organoleptic evaluation. The rank of 3 or higher is a level which can be put to practical use.

| Developing Solution A | |
|---|---|
| Hydroquinone | 45.0 g |
| N-Methyl-p-aminophenol ½ sulfate | 0.8 g |
| Sodium hydroxide | 18.0 g |
| Potassium hydroxide | 55.0 g |
| 5-Sulfosalicylic acid | 45.0 g |
| Boric acid | 25.0 g |
| Potassium sulfite | 110.0 g |
| Disodium ethylenediamine tetraacetate | 1.0 g |
| Potassium bromide | 6.0 g |
| 5-Methylbenztriazole | 0.6 g |
| n-Butyl-diethnolamine | 15.0 g |
| Water added to make | 1 liter (pH = 11.6) |

The results are shown in Table 4. It is apparent from Table 4 that the coated samples of the present invention can be rapidly processed in a period of not longer than 60 seconds or and exhibit excellent offprinted letter performance.

TABLE 4

| Sample No. | | Image Quality of Offprinted Letter |
|---|---|---|
| 3-1 | Comp. Ex. | 2.5 |
| 3-2 | " | 1.0 |
| 3-3 | Invention | 3.5 |
| 3-4 | " | 3.5 |

EXAMPLE 4

(1) Preparation of Emulsion 5 g of potassium bromide, 0.05 g of potassium iodide, 25.5 g of gelatin and 2.5 cc of a 5% aqueous solution of thioether $HO(CH_2)_2S(CH_2)_2S(CH_2)_2OH$ were added to 1 l of water. The resulting solution was kept at 69° C., and an aqueous solution of 8.35 g of silver sulfate and an aqueous solution containing 5.94 g of potassium bromide and 0.726 g of potassium iodide were added with stirring over a period of 45 seconds by the double jet process. 2.9 g of potassium bromide was added thereto. Subsequently, an aqueous solution containing 8.35 g of silver nitrate was added thereto over a period of 26 minutes at such a rate that the flow rate at the time of completion of the addition was twice that at the time of commencement of the addition. Thereafter, 20 cc of 25% ammonia solution and 10 cc of 50% $NH_4NO_3$ were added thereto and physical ripening was carried out for 20 minutes. Neutralization was then carried out by adding 240 cc of 1N sulfuric acid. Subsequently, an aqueous solution of 149.9 g of silver nitrate and an aqueous solution of potassium bromide were added thereto over a period of 40 minutes by means of the controlled double jet process while potential was kept at a pAg of 8.2. The addition was carried out at such an accelerating rate that the flow rate at the time of completion of the addition was 9 times that at the time of commencement of the addition. After completion of the addition, 15 cc of 2N potassium thiocyanate solution was added thereto. Further, 25 cc of a 1% aqueous solution of potassium iodide was added thereto over a period of 30 seconds. The temperature of the mixture was lowered to 35° C. and soluble salts were removed by the precipitation method. The temperature was elevated to 40° C. 73.4 g of gelatin and 1.2 g of Proxel were added thereto. The pH was adjusted to 6.40 and the pAg was adjusted to 8.10 by using sodium hydroxide and potassium bromide, respectively.

After the temperature was raised to 56° C., 600 mg of the following sensitizing dye and 150 mg of the following stabilizer were added thereto. After 10 minutes, 2.4 mg of sodium thiosulfate pentahydrate, 140 mg of potassium thiocyanate and 2.1 mg of chloroauric acid were added to each emulsion. After 80 minutes, the mixture was solidified by quenching to obtain an emulsion. The resulting emulsion was composed of grains having such a grain size distribution that grains having an aspect ratio of not lower than 3 accounted for 95% of the total of the projected areas of the entire grains. With regard to all grains having an aspect ratio of not lower than 2, the average diameter of the projected area was 1.4 μm, the standard deviation was 15%, the average thickness was 0.190 μm and the aspect ratio was 7.4.

Sensitizing dye

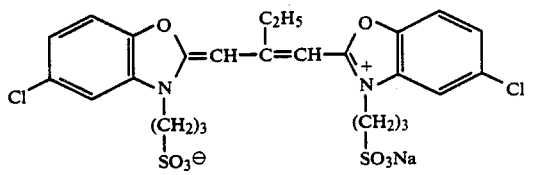

Stabilizer

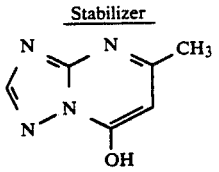

(2) Preparation of Emulsion Coating Solution

The following reagents were added to the emulsion to prepare a coating solution, each amount being per mol of silver halide.

| | |
|---|---|
| Polymer latex (poly(ethyl acrylate/methacrylic acid) = 97/3) | 25.0 g |
| Hardening agent (1,2-Bis(sulfonyl-acetamido)ethane) | 8 mmol/10 g of gelatin in surface protective layer and emulsion layer |
| 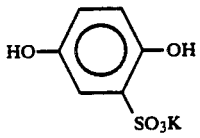 | 12.0 g |
| 2,6-Bis(hydroxyamino)-4-diethylamino-1,3,5-triazine | 80 mg |

-continued

| | |
|---|---|
| Polysodium acrylate (average molecular weight: 41,000) | 4.0 g |
| Polypotassium styrenesulfonate (average molecular weight: 600,000) | 1.0 g |

(3) Preparation of Coating Solution for Surface Protective Layer

The coating solution for the surface protective layer was prepared by using each component in such an amount as to give the following coating weight.

| Surface Protective Layer | Coating Weight |
|---|---|
| Gelatin | 1.15 g/m$^2$ |
| Polyacrylamide (average molecular weight: 45,000) | 0.25 g/m$^2$ |
| Polysodium acrylate (average molecular weight: 400,000) | 0.02 g/m$^2$ |
| Sodium salt of sulfonated p-t-octylphenoxyglycerylbutyl | 0.02 g/m$^2$ |
| Poly (degree of polymerization: 10)-oxyethylene cetyl ether | 0.035 g/m$^2$ |
| Poly (degree of polymerization: 10)-oxyethylene poly (degree of polymerization: 3)oxyglyceryl p-octylphenoxy ether | 0.01 g/m$^2$ |
| $C_8F_{17}SO_3K$ | 0.003 g/m$^2$ |
| $C_8F_{17}SO_2N(C_3H_7)(CH_2)_4(CH_2)_4SO_3Na$ | 0.001 g/m$^2$ |
| $C_8F_{17}SO_2N(C_3H_7)(CH_2CH_2O)_{10}(CH_2CHCH_2O)_4H$ | 0.003 g/m$^2$ |
| Polymethyl methacrylate (average particle diameter: 3.5 μm) | 0.025 g/m$^2$ |
| Poly(methyl methacrylate/methacrylate) (molar ratio = 7:3, average particle diameter: 2.5 μm) | 0.020 g/m$^2$ |

(4) Preparation of Colored Layer

A bixially oriented polyethylene terephthalate film (dyed blue) of 175 μm in thickness was subjected to corona discharge treatment and then one side was coated with the following first undercoating solution by means of a wire bar coater in such an amount as to give the following coating weights. The coated film was dried at 175° C. for one minute. The other side thereof was coated in the same way to form a first undercoat layer.

| Coating Solution for First Undercoat Layer | |
|---|---|
| Butadiene-styrene copolymer latex solution* (solid content: 40%, butadiene/styrene ratio = 31/69 by weight) | 79 cc |
| Sodium salt of 2,4-dichloro-6-hydroxy-s-triazine | 50 mg/g of gelatin in second undercoat layer |
| Distilled water added | up to 1000 cc |

*The latex solution contained 0.4 wt % (based on the amount (on a solid basis) of latex) of the following compound as an emulsifying dispersant.

Emulsifying dispersant

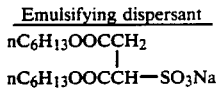

Preparation of Colored Layer of Comparative Photographic Materials 1 to 4 and 8 to 10

The surface of the first undercoat layer was coated with the following coating solution to form a second undercoat layer on both sides of the coated film.

| | |
|---|---|
| Gelatin | amount given in Table 5 |
| Compound A | amount given in Table 5 |
| 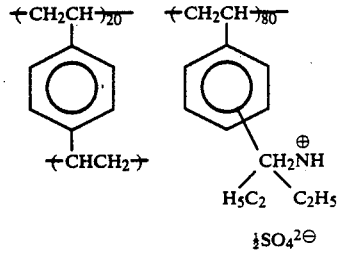 | |
| Dye | Compounds (Comparative Dye 1, I-1, III-2) and amounts given in Table 5 (Dyes I-1 and III-2 were added as a solid particle dispersion according to the invention) |
| $C_{12}H_{25}O(CH_2CH_2O)_{10}H$ | 7.5 mg/m$^2$ |

Preparation of Colored Layer of Photographic Materials 5 to 7

The surface of the first undercoat layer was coated with the following second undercoat layer, thus forming the second undercoat layer on both sides of the coated film.

| | |
|---|---|
| Gelatin | 0.075 g/m$^2$ |
| $C_{12}H_{25}O(CH_2CH_2O)_{10}H$ | 7.5 mg/m$^2$ |

Further, the surface of the second undercoat layer was coated with a layer (containing gelatin in an amount given in Table 5 and a dye in an amount given in Table 5 together with 1,2-bis(sulfonylacetamido)ethane as hardening agent in an amount of 8 mmol per 100 g of gelatin given in Table 5) to form a colored layer. The dye was added as a solid particle dispersion according to the present invention.

The surface of the base having the thus-formed colored layer thereon was coated with the above-described emulsion coating solution and the above-described solution for the surface protective layer simultaneously. The coated weight of silver was 2.0 g/m$^2$.

(5) Evaluation of Photographic Performance

An HR-y screen manufactured by Fuji Photo Film Co., Ltd. was used as screen for exposure. Each of Photographic Materials 1 to 10 was placed between two closely-spaced sheets of HR-y screens and exposed to X-rays through water phantom 10 cm. Thereafter, 45 second dry to dry processing was carried out by using an FPM9000 automatic processor manufactured by Fuji Photo Film Co., Ltd. Developing solution (RD-7, a product of Fuji Photo Film Co., Ltd.) and a fixing solution (Fuji F, a product of Fuji Photo Film Co., Ltd.) were used as the processing solutions. Sensitivity was represented by the ratio of the reciprocal of the exposure amount giving a density of 1.0+fog. The sensitivity of Photographic Material 1 was referred to as 100.

The results are shown in Table 5.

(6) Evaluation of After-Color

Photographic Materials 1 to 10 were processed in the same way as in the processing for the evaluation of photographic performance except that the photographic materials were not exposed. After-color after processing was organoleoptically evaluated. The results are shown in Table 5, based on a rating according to the following classification.

◎: After color is unnoticeable.

○: After-color is slightly formed, but it is no problem in practical use.

Δ: After-color is noticeable and is a problem in practical use.

X: After-color is clearly observed and the photographic material cannot be put to practical use.

(7) Evaluation of MTF

The evaluation of MTF was made by a conventional method as follows. Exposure and processing were carried out in the same way as in the evaluation of photographic performance. The results were measured with an aperture of 30×500 μm. An evaluation was made by the value of a spatial frequency of 2.0 line/mm.

The results are shown in Table 5.

(8) Evaluation of Dryness

Film having a size of 24.5×30.5 cm was processed in the above-described automatic processor. Film discharged from the drying zone was immediately touched with the hand and dryness was inspected.

The results are shown in Table 5, based on a rating according to the following classfication.

◎: Film discharged was considerably warm and sufficiently dried.

○: Film discharged was slightly warm and dried.

▲ : Film discharged was damp and insufficiently dried.

X: Film discharges was wetted and stuck to other film.

(9) Evaluation of Swelling Ratio

The swelling ratios (percentage) of samples which were coated with emulsion but not processed were measured 7 days after coating. The samples were incubated at 38° C. and 50% RH for 3 out of the 7 days. The thickness of the emulsion layer was measured first, and each sample was then immersed in distilled water at 21° C. for 3 minutes. The change in the thickness of the emulsion layer was measured.

The swelling ratio of Photographic Materials 1 to 10 was 230%.

TABLE 5

| Photographic Material | Additives of Colored Layer (per one side): Amount of Compound A (mg/m²) | Dye | Amount of Dye (mg/m²) | Amount of Gelatin (g/m²) | Sensitivity | After-Color | MTF (2 line/mm) | Dryness |
|---|---|---|---|---|---|---|---|---|
| 1 (Comp. Ex.) | — | — | — | 0.075 | 100 | ◎ | 0.42 | ◎ |
| 2 (Comp. Ex.) | 35 | Comp. Dye 1 | 15 | 0.075 | 89 | ○ | 0.46 | ◎ |
| 3 (Comp. Ex.) | 105 | " | 45 | 0.25 | 87 | Δ | 0.50 | ◎ |
| 4 (Comp. Ex.) | 210 | " | 90 | 0.5 | 83 | X | 0.55 | ○ |
| 5 (Comp. Ex.) | — | I-1 | 90 | 1.6 | 87 | ◎ | 0.56 | X |
| 6 (Comp. Ex.) | — | I-1 | 90 | 0.8 | 87 | ◎ | 0.56 | ▲ |
| 7 (Invention) | — | I-1 | 90 | 0.5 | 87 | ◎ | 0.56 | ○-▲ |
| 8 (Invention) | — | I-1 | 90 | 0.5 | 87 | ◎ | 0.56 | ○ |
| 9 (Invention) | — | I-1 | 45 | 0.25 | 91 | ◎ | 0.51 | ◎ |
| 10 (Invention) | — | III-2 | 45 | 0.25 | 89 | ○ | 0.52 | ◎ |

(Comparative Dye 1)

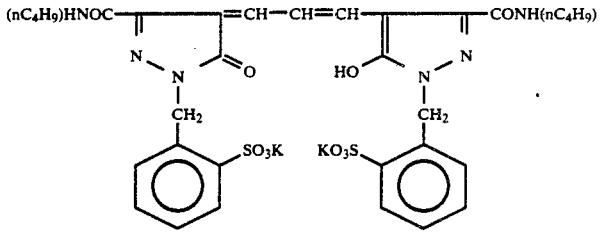

It is apparent from Table 5 that Photographic Materials 7 to 10 of the present invention are excellent in sensitivity, after-color, sharpness (MTF) and dryness. It can be seen from Table 5 that the dryness is deteriorates unless the amount of gelatin is 0.5 g/m² or less.

Photographic Material 8, wherein the colored layer is incorporated in the undercoat layer, can dispense with the amount of gelatin to be used for the undercoat layers and has an advantage in dryness in comparison with the Photographic Material 7.

Further, a problem occurred in that the solid particle of the dye could not be held by gelatin, and they dropped out when the size of the solid particle of the dye was larger than 0.3 μm and the amount of gelatin in the colored layer was small, i.e., not larger than 0.5 g/m². Accordingly, the size of the solid particle of the dye had to be not larger than 0.3 μm.

When the amount of the hardening agent was increased to improve the dryness of Photographic Materials 5 and 6 and the swelling ratio was brought down to 150% to 200%, the dryness changed from x- ▲ to ○-◎. However, the density in the region of high exposure decreased and after-color changed from ◎ to Δ. Thus, these materials were still inferior to those of the present invention.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a hydrophilic colloid layer containing therein a dye dispersed in a solid particle form on at least one side of a support and at least one silver halide emulsion layer, wherein the coating weight of hydrophilic colloid in said hydrophilic colloid layer containing therein a dye dispersed in a solid particle form is from 0.05 to 0.5 $g/m^2$ and the total coating weight of hydrophilic colloid on each side of said support is from 0.5 to 3 $g/m^2$, wherein said material comprises at least one undercoat layer comprising a first undercoat layer which contains polymers on a surface of said support and a second undercoat layer which contains hydrophilic colloid on the first undercoat layer, and said second undercoat layer is said hydrophilic colloid layer containing therein a dye dispersed in a solid particle form, and wherein said polymers are selected from the group consisting of styrene-butadiene copolymers and vinylidene chloride copolymers.

2. A silver halide photographic material as in claim 1, wherein said coating weight of hydrophilic colloid in said hydrophilic colloid layer containing therein a dye dispersed in a solid particle form is from 0.05 to 0.4 $g/m^2$.

3. A method for processing a silver halide photographic material comprising a hydrophilic colloid layer containing therein a dye dispersed in a solid particle form on at least one side of a support and at least one silver halide emulsion layer, wherein the coating weight of hydrophilic colloid in said hydrophilic colloid layer containing therein a dye dispersed in a solid particle form is from 0.05 to 0.5 $g/m^2$ and the total coating weight of hydrophilic colloid on each side of said support is from 0.5 to 3 $g/m^2$, wherein said material comprises at least one undercoat layer comprising a first undercoat layer which contains polymers on a surface of said support and a second undercoat layer which contains hydrophilic colloid on the first undercoat layer, and said second undercoat layer is said hydrophilic colloid layer containing therein a dye dispersed in a solid particle form, and wherein said polymers are selected from the group consisting of styrene-butadiene copolymers and vinylidene chloride copolymers, which method comprises exposing said silver halide photographic material and then processing said silver halide photographic material in a short period of not longer than 60 seconds.

4. A method for processing a silver halide photographic material as in claim 3, wherein the processing time is not longer than 45 seconds.

5. A method for processing a silver halide photographic material as in claim 3, wherein said coating weight of hydrophilic colloid in said hydrophilic colloid layer containing therein a dye dispersed in a solid particle form is from 0.05 to 0.4 $g/m^2$.

* * * * *